US010656564B2

(12) United States Patent
Takayanagi

(10) Patent No.: US 10,656,564 B2
(45) Date of Patent: May 19, 2020

(54) IMAGE FORMING APPARATUS

(71) Applicant: CANON KABUSHIKI KAISHA, Tokyo (JP)

(72) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/890,123

(22) Filed: Feb. 6, 2018

(65) Prior Publication Data

US 2018/0224774 A1 Aug. 9, 2018

(30) Foreign Application Priority Data

Feb. 9, 2017 (JP) ..... 2017-022567

(51) Int. Cl.

| | |
|---|---|
| ***G03G 15/16*** | (2006.01) |
| ***G03G 21/00*** | (2006.01) |
| ***G03G 15/00*** | (2006.01) |
| ***G03G 15/02*** | (2006.01) |
| ***G03G 15/01*** | (2006.01) |

(52) U.S. Cl.

CPC ..... *G03G 15/161* (2013.01); *G03G 15/0189* (2013.01); *G03G 15/0283* (2013.01); *G03G 15/167* (2013.01); *G03G 15/80* (2013.01); *G03G 21/0017* (2013.01); *G03G 15/1675* (2013.01)

(58) Field of Classification Search

None

See application file for complete search history.

(56) References Cited

U.S. PATENT DOCUMENTS

| | | | | |
|---|---|---|---|---|
| 5,557,384 | A | 9/1996 | Takano et al. | |
| 7,929,877 | B2 * | 4/2011 | Saeki | B41J 2/0057 399/298 |
| 2009/0136270 | A1 | 5/2009 | Yamada | |
| 2011/0150540 | A1 * | 6/2011 | Saeki | B41J 2/0057 399/308 |
| 2013/0259506 | A1 * | 10/2013 | Katagiri | G03G 15/1675 399/66 |
| 2015/0362866 | A1 | 12/2015 | Matsushita | |
| 2016/0077468 | A1 * | 3/2016 | Kojima | G03G 15/1665 399/66 |
| 2018/0181033 | A1 * | 6/2018 | Minobe | G03G 15/1675 |
| 2019/0137910 | A1 * | 5/2019 | Katagiri | G03G 15/1675 |

FOREIGN PATENT DOCUMENTS

| | | | |
|---|---|---|---|
| JP | 9-114273 | A | 5/1997 |
| JP | 2006-201412 | A | 8/2006 |
| JP | 4323775 | B2 | 9/2009 |
| JP | 2014-032294 | A | 2/2014 |
| JP | 2014-89387 | A | 5/2014 |

* cited by examiner

*Primary Examiner* — Sevan A Aydin

(74) *Attorney, Agent, or Firm* — Canon U.S.A. Inc., IP Division

(57) ABSTRACT

An image forming apparatus provides a configuration capable of suppressing an increase in the resistance of an intermediate transfer belt. The image forming apparatus includes an electrification unit for electrifying an intermediate transfer belt to suppress an increase in resistance of the intermediate transfer belt.

9 Claims, 22 Drawing Sheets

FIG.7

| | ABSOLUTE AMOUNT OF MOISTURE OUTSIDE APPARATUS (g/kg-Dry Air) | | |
|---|---|---|---|
| | – LESS THAN 3 | 3 – LESS THAN 12 | 12 – |
| Vs (V) | 90 | 125 | 155 |
| I2 (μA) | 95 | 120 | 140 |

CLEANING VOLTAGE
V1
V0
Vs
TIME

ELECTRIFICATION CURRENT
I2
I1
TIME

PRIMARY TRANSFER VOLTAGE
Vtr
TIME

PRIMARY TRANSFER VOLTAGE
TARGET CURRENT
TIME
DURING IMAGE FORMATION (DURING CONTINUOUS ELECTRIFICATION)
DURING STANDBY (DURING NON-ELECTRIFICATION)
DURING IMAGE FORMATION FOR NEXT JOB (DURING CONTINUOUS ELECTRIFICATION)

FIG.9

| | ABSOLUTE AMOUNT OF MOISTURE OUTSIDE APPARATUS (g/kg-Dry Air) | | |
|---|---|---|---|
| | – LESS THAN 3 | 3 – LESS THAN 12 | 12 – |
| Vs (V) | 90 | 125 | 155 |

FIG.10

| | V1 – V0 (V) | | | | | |
|---|---|---|---|---|---|---|
| | 90 OR MORE AND LESS THAN 100 | 100 OR MORE AND LESS THAN 110 | 110 OR MORE AND LESS THAN 120 | 120 OR MORE AND LESS THAN 135 | 135 OR MORE AND LESS THAN 155 | 155 OR MORE |
| I2 (μA) | 95 | 105 | 115 | 120 | 130 | 145 |

FIG.12

| | ABSOLUTE AMOUNT OF MOISTURE OUTSIDE APPARATUS (g/kg-Dry Air) | | |
|---|---|---|---|
| | – LESS THAN 3 | 3 – LESS THAN 12 | 12 – |
| Vs (V) | 90 | 130 | 160 |

FIG.13

| | V1 – V0 (V) | | | | | |
|---|---|---|---|---|---|---|
| | 90 OR MORE AND LESS THAN 100 | 100 OR MORE AND LESS THAN 110 | 110 OR MORE AND LESS THAN 120 | 120 OR MORE AND LESS THAN 135 | 135 OR MORE AND LESS THAN 155 | 155 OR MORE |
| I2 (μA) | 95 | 105 | 115 | 120 | 130 | 145 |

FIG.16

| | ABSOLUTE AMOUNT OF MOISTURE OUTSIDE APPARATUS (g/kg-Dry Air) | | |
|---|---|---|---|
| | – LESS THAN 3 | 3 – LESS THAN 12 | 12 – |
| Vs (V) | 140 | 200 | 250 |
| I2 (μA) | -95 | -120 | -140 |

VOLTAGE
TIME
ΔV
L
L

TIME
I1
I2
ELECTRIFICATION CURRENT

PRIMARY TRANSFER VOLTAGE
Vtr
TIME

PRIMARY TRANSFER VOLTAGE
TARGET CURRENT
TIME
DURING IMAGE FORMATION (DURING CONTINUOUS ELECTRIFICATION)
DURING STANDBY (DURING NON-ELECTRIFICATION)
DURING IMAGE FORMATION FOR NEXT JOB (DURING CONTINUOUS ELECTRIFICATION)

FIG.18

| | ABSOLUTE AMOUNT OF MOISTURE OUTSIDE APPARATUS (g/kg-Dry Air) | | |
|---|---|---|---|
| | – LESS THAN 3 | 3 – LESS THAN 12 | 12 – |
| Vs (V) | 140 | 200 | 250 |

FIG.19

| | DIFFERENCE VOLTAGE FLUCTUATION D (V) | | | | | |
|---|---|---|---|---|---|---|
| | 140 OR MORE AND LESS THAN 160 | 160 OR MORE AND LESS THAN 175 | 175 OR MORE AND LESS THAN 190 | 190 OR MORE AND LESS THAN 215 | 215 OR MORE AND LESS THAN 250 | 250 OR MORE |
| I2 (μA) | -95 | -105 | -115 | -120 | -130 | -145 |

IMAGE FORMING APPARATUS

BACKGROUND OF THE INVENTION

Field of the Invention

The present disclosure generally relates to an image forming apparatus, such as a copying machine, a printer, a facsimile, and a multifunction peripheral having a plurality of functions of these apparatuses.

Description of the Related Art

Conventionally, an image forming apparatus for primarily transferring a toner image from a photosensitive drum as an image bearing member onto an intermediate transfer belt serving as an intermediate transfer member, and secondarily transferring onto a recording material the toner image primarily transferred onto the intermediate transfer belt is known. Further, in such an image forming apparatus, a configuration discussed in, for example, the publication of Japanese Patent No. 4323775 is known in which active transfer voltage control (ATVC) is executed before an image forming operation to set an appropriate transfer voltage The resistance of the intermediate transfer belt increases due to the electrification of the intermediate transfer belt involved in image formation. Thus, for example, control of a transfer voltage setting, such as the above ATVC, is executed before the start of an image forming operation. If, however, such transfer voltage setting control is performed before the start of an image forming operation, the time from the input of an image formation start signal to the output of an image becomes long, and productivity decreases. Thus, it is desirable to reduce the execution frequency of transfer voltage setting control. If, however, the execution frequency of transfer voltage setting control is simply reduced, an appropriate transfer current may not flow.

SUMMARY OF THE INVENTION

The present disclosure is generally directed to image processing and, more particularly, to providing a configuration capable of suppressing an increase in the resistance of an intermediate transfer member due to the electrification of the intermediate transfer member involved in image formation.

According to an aspect of the present disclosure, an image forming apparatus includes an image bearing member configured to bear a toner image, an intermediate transfer member onto which the toner image is transferred from the image bearing member at a primary transfer portion, a primary transfer device configured to transfer the toner image from the image bearing member to the intermediate transfer member, a secondary transfer device configured to, at a secondary transfer portion, transfer the toner image transferred onto the intermediate transfer member onto a recording material, a first electrification device placed downstream of the secondary transfer portion and upstream of the primary transfer portion in a moving direction of the intermediate transfer member and configured to apply a current to the intermediate transfer member, a second electrification device placed downstream of the secondary transfer portion and upstream of the primary transfer portion in the moving direction of the intermediate transfer member and configured to apply a current to the intermediate transfer member, and a controller configured to control the first electrification device and the second electrification device, wherein the controller controls a voltage to be applied to the first electrification device so that a predetermined target current flows through the first electrification device, and wherein based on a first voltage to be applied to the first electrification device at a first timing during an image forming job, and a second voltage to be applied to the first electrification device at a second timing during the image forming job, the controller controls an operation of the second electrification device.

Further features of the present disclosure will become apparent from the following description of exemplary embodiments with reference to the attached drawings.

BRIEF DESCRIPTION OF THE DRAWINGS

FIGS. 6A and 6B, is a flowchart illustrating voltage control according to the first exemplary embodiment.

FIG. 7 is a diagram illustrating relationships between an amount of moisture outside the apparatus, and a threshold and a second current value according to the first exemplary embodiment.

FIG. 9 is a diagram illustrating a relationship between an amount of moisture outside an apparatus and a threshold according to a second exemplary embodiment.

FIG. 10 is a diagram illustrating a relationship between a difference, between cleaning voltages, and a second current value according to the second exemplary embodiment.

FIG. 12 is a diagram illustrating a relationship between an amount of moisture outside an apparatus and a threshold according to the third exemplary embodiment.

FIG. 13 is a diagram illustrating a relationship between a difference, between primary transfer voltages, and a second current value according to the third exemplary embodiment.

FIGS. 15A and 15B, is a flowchart illustrating voltage control according to the fourth exemplary embodiment.

FIG. 16 is a diagram illustrating relationships between an amount of moisture outside the apparatus, and a threshold and a second current value according to the fourth exemplary embodiment.

FIG. 18 is a diagram illustrating a relationship between an amount of moisture outside an apparatus and a threshold according to a fifth exemplary embodiment.

FIG. 19 is a diagram illustrating a relationship between a difference voltage and a second current value according to the fifth exemplary embodiment.

DESCRIPTION OF THE EMBODIMENTS

Figure 1:
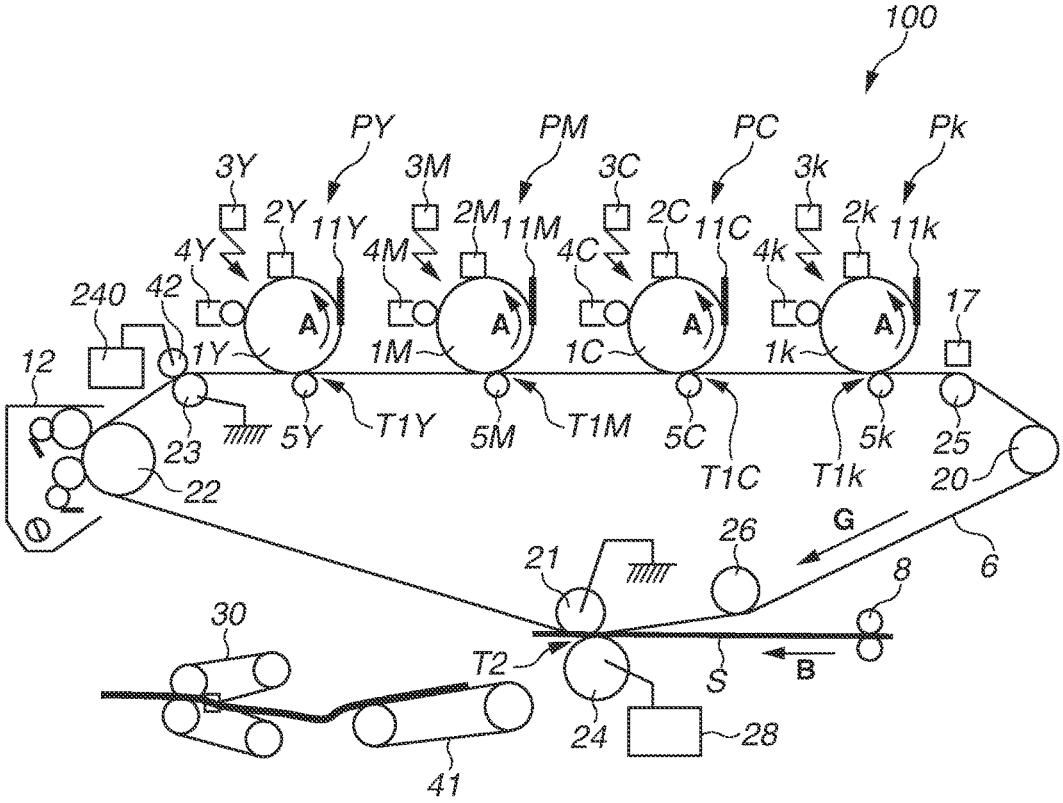
FIG. 1 is a diagram illustrating a general configuration of an image forming apparatus according to a first exemplary embodiment.

A first exemplary embodiment is described using FIGS. 1 to 8D. First, the general configuration of an image forming apparatus according to the present exemplary embodiment is described using FIG. 1.

[Image Forming Apparatus]

An image forming apparatus 100 is a full-color electrophotographic printer including four image forming units PY, PM, PC, and Pk, which are provided corresponding to four colors, namely yellow, magenta, cyan, and black. In the present exemplary embodiment, the image forming apparatus 100 is a tandem image forming apparatus in which the image forming units PY, PM, PC, and Pk are arranged along the rotational direction of an intermediate transfer belt 6. The image forming apparatus 100 forms a toner image (an image) on a recording material S according to an image signal from a document reading apparatus (not illustrated) connected to the main body of the image forming apparatus 100 or from a host device, such as a personal computer connected to the main body of the image forming apparatus 100 so that the host device can communicate with the image forming apparatus 100. Examples of the recording material S include sheet materials, such as paper, plastic film, and cloth.

The outline of such an image forming process is described. First, the image forming units PY, PM, PC, and Pk form toner images of the respective colors on photosensitive drums 1Y, 1M, 1C, and 1*k*, respectively. The thus formed toner images of the respective colors are transferred onto the intermediate transfer belt 6 and then transferred from the intermediate transfer belt 6 onto the recording material S. The recording material S onto which the toner images are transferred is conveyed to a fixing device 30, and the toner images are fixed to the recording material S. The details are described below.

The four image forming units PY, PM, PC, and Pk included in the image forming apparatus 100 have substantially similar configurations except that developing colors are different from each other. Each includes a charging device (2Y, 2M, 2C, 2K), a developing device (4Y, 4M, 4C, 4K), an exposure device (3Y, 3M, 3C, 4K), a primary transfer device (4Y, 4M, 4C, 4K), and a cleaning device (11Y, 11M, 11C, 11K). The image forming unit PY is described below on behalf of the image forming units PY, PM, PC, and Pk, and the description of the other image forming units PM, PC, and Pk is omitted.

In the image forming unit PY, a cylindrical photosensitive member, i.e., a photosensitive drum 1Y, is disposed as an image bearing member. The photosensitive drum 1Y is driven to rotate in the direction of an arrow A in FIG. 1. Around the photosensitive drum 1Y, a charging device 2Y, a developing device 4Y, a primary transfer roller 5Y, and a cleaning device 11Y are placed. Above the photosensitive drum 1Y in FIG. 1, a laser scanner (exposure device) 3Y is placed.

Further, an intermediate transfer belt 6 as an intermediate transfer member is placed facing the photosensitive drums 1Y, 1M, 1C, and 1*k*. The intermediate transfer belt 6 is stretched by a plurality of rollers and rotate (move) in the direction of an arrow G in FIG. 1. Further, at a position facing a secondary transfer inner roller 21, which stretches the intermediate transfer belt 6, across the intermediate transfer belt 6, a secondary transfer outer roller 24 is placed, and the secondary transfer inner roller 21 and the secondary transfer outer roller 24 form a secondary transfer portion T2, which transfers a toner image on the intermediate transfer belt 6 onto the recording material S. Downstream of the secondary transfer portion T2 in the conveying direction of the recording material S, a fixing device 30 is placed.

A description is given of the process in which the image forming apparatus 100 configured as described above forms an image. First, if an image forming operation is started, the surface of the rotating photosensitive drum 1Y is uniformly charged by the charging device 2Y. Next, the photosensitive drum 1Y is exposed to laser light corresponding to an image signal given by the exposure device 3Y. Consequently, an electrostatic latent image according to the image signal is formed on the photosensitive drum 1Y. The electrostatic latent image on the photosensitive drum 1Y is visualized as a toner image by toner stored in the developing device 4Y. In the present exemplary embodiment, a reverse developing method for attaching toner to an exposed portion of an electrostatic latent image to develop an image is used.

The toner image formed on the photosensitive drum 1Y is primarily transferred onto the intermediate transfer belt 6 at a primary transfer portion T1Y, which is formed between the photosensitive drum 1Y and the primary transfer roller 5Y, which is placed across the intermediate transfer belt 6. That is, a predetermined primary transfer bias is applied from a transfer high-voltage power supply 220 (see FIG. 4) to the primary transfer roller 5Y. Consequently, at the primary transfer portion T1Y, a primary transfer current flows from the photosensitive drum 1Y to the intermediate transfer belt 6, and the toner image on the photosensitive drum 1Y is primarily transferred onto the intermediate transfer belt 6. Toner (transfer residual toner) remaining on the surface of the photosensitive drum 1Y, after the primary transfer, is removed by the cleaning device 11Y.

The image forming units PM, PC, and Pk, which correspond to magenta, cyan, and black, respectively, also sequentially perform such operations, and the toner images of the four colors are superimposed on each other on the intermediate transfer belt 6. Then, according to the formation timing of the toner image, the recording material S stored in a recording material storage cassette (not illustrated) is conveyed in the direction of an arrow B by registration rollers 8. Then, the conveyance of the recording material S by the registration rollers 8 is controlled in synchronization with the timing when a front end portion of the toner image on the intermediate transfer belt 6 reaches the secondary transfer portion T2.

The recording material S conveyed to the secondary transfer portion T2 is nipped and conveyed by the intermediate transfer belt 6 and the secondary transfer outer roller 24. In this process, a predetermined secondary transfer bias is applied from a secondary transfer high-voltage power supply 28 to the secondary transfer outer roller 24. A secondary transfer bias having a polarity opposite to that of the toner is applied to the secondary transfer outer roller 24, so that the full-color image of the four colors superimposed on the intermediate transfer belt 6 is collectively secondarily transferred onto the recording material S in the secondary transfer portion T2. Consequently, a full-color unfixed toner image is formed on the recording material S.

Toner that has not been transferred in the secondary transfer portion T2 and remains on the intermediate transfer belt 6 is removed by a belt cleaning device 12 as a cleaning unit. Upstream of the primary transfer portion T1Y in the rotational direction (the moving direction) of the intermediate transfer belt 6, an opposing electrode 42 as an electrification unit is placed so that a current in the opposite direction to that of the primary transfer current is applied from the opposing electrode 42 to the intermediate transfer belt 6.

Next, the recording material S is conveyed to the fixing device 30 by a pre-fixing conveying device 41. The pre-fixing conveying device 41 includes a conveying belt that is driven to rotate. The conveying belt can be composed of a rubber material, such as ethylene-propylene-diene rubber (EPDM). The conveying belt can have a plurality of holes and be connected to a suction device (not illustrated) such that, air is suctioned from inside the conveying belt so that the recording material S is supported on the conveying belt. The conveying belt rotates, whereby the recording material S is stably conveyed.

The recording material S conveyed by the pre-fixing conveying device 41 is heated and pressurized by the fixing device 30, whereby the toner on the recording material S is fused and mixed, and is fixed as a full-color image to the recording material S. Then, the recording material S is discharged to outside the apparatus. Consequently, a series of processes regarding the image forming process ends. It is also possible to form an image of a single desired color or a plurality of desired colors using only desired image forming units.

[Intermediate Transfer Belt]

Next, the intermediate transfer belt 6 as the intermediate transfer member is described in further detail. The intermediate transfer belt 6 is an endless belt including an elastic layer containing a conductive material. The intermediate transfer belt 6 is stretched by a tension roller 20, the secondary transfer inner roller 21, a driving roller 22, and stretching rollers 23, 25, and 26 and rotates in the direction of the arrow G. The tension roller 20 gives a certain tension to the intermediate transfer belt 6. The driving roller 22 is driven by a motor (not illustrated) to drive and rotate the intermediate transfer belt 6.

The intermediate transfer belt 6 includes a base layer (a layer on the back surface), an elastic layer (an intermediate layer), and a surface layer. The base layer is formed by a resin, such as polyimide or polycarbonate, or various types of rubber containing an appropriate amount of carbon black as an antistatic agent and has a thickness of 0.05 to 0.15 mm. The elastic layer is formed by various types of rubber, such as chloroprene rubber (CR rubber), urethane rubber, and silicone rubber, containing an appropriate amount of an ion conductive agent and has a thickness of 0.1 to 0.500 mm. The surface layer is formed of a resin, such as a urethane resin or a fluororesin, and has a thickness of 0.0002 to 0.020 mm.

The volume resistivity of the intermediate transfer belt 6 is 5E+8 to 1E+14 Ω·cm (23° C., a relative humidity (RH) of 50%), and the hardness of the intermediate transfer belt 6 is an MD-1 hardness of 60° to 85° (23° C., an RH of 50%). The static friction coefficient of the intermediate transfer belt 6 is 0.15 to 0.6 (23° C., an RH of 50%).

[Secondary Transfer Device]

Next, the configuration of the secondary transfer device is described. A secondary transfer portion T2 is formed between the secondary transfer inner roller 21 and the secondary transfer outer roller 24 as a secondary transfer means through the intermediate transfer belt 6. Then, the recording material S conveyed from the registration rollers 8 is nipped and conveyed between the secondary transfer outer roller 24 and the intermediate transfer belt 6. In this process, a secondary transfer bias controlled at a constant voltage having a polarity opposite to that of a toner image is applied to the secondary transfer outer roller 24, so that the toner image on the intermediate transfer belt 6 is secondarily transferred onto the recording material S. For example, a secondary transfer voltage of +1 to +7 kV is applied to the secondary transfer outer roller 24, and a secondary transfer current of +40 to +120 μA is applied to the secondary transfer device, whereby the toner image on the intermediate transfer belt 6 is transferred onto the recording material S.

The secondary transfer outer roller 24 is composed of an elastic layer made of ion conductive foamed rubber and a metal core and has an outer diameter of 20 to 25 mm. In a case where the secondary transfer outer roller 24 is measured in an environment of 23° C. and an RH of 50%, the resistance value of the secondary transfer outer roller 24 is 1E+5 to 1E+8Ω when 2 kV is applied. The secondary transfer inner roller 21 is composed of an elastic layer made of electronically conductive rubber and a metal core and has an outer diameter of 20 to 22 mm. In a case where the secondary transfer inner roller 21 is measured in an environment of 23° C. and an RH of 50%, the resistance value of the secondary transfer inner roller 21 is 1E+5 to 1E+8Ω when 50 V is applied.

[Primary Transfer Device]

Next, the configurations of the primary transfer devices are described. Primary transfer portions T1Y, T1M, T1C, and T1*k* are formed between the primary transfer rollers 5Y, 5M, 5C, and 5*k* and the photosensitive drums 1Y, 1M, 1C, and 1*k*, respectively, through the intermediate transfer belt 6. In synchronization with the conveyance of toner images of the respective colors to the primary transfer portions T1Y, T1M, T1C, and T1*k*, a primary transfer bias controlled at a constant voltage having a polarity opposite to that of the toner images is applied to the primary transfer devices. Consequently, the toner images on the photosensitive drums 1Y, 1M, 1C, and 1*k* are primarily transferred onto the intermediate transfer belt 6.

Each of the primary transfer rollers 5Y, 5M, 5C, and 5*k* is composed of an elastic layer made of ion conductive foamed rubber and a metal core and has an outer diameter of 15 to 20 mm. In a case where the primary transfer roller is measured in an environment of 23° C. and an RH of 50%, the resistance value of the primary transfer roller is 1E+5 to 1E+8Ω when 2 kV is applied.

[Belt Cleaning Device]

Figure 2:
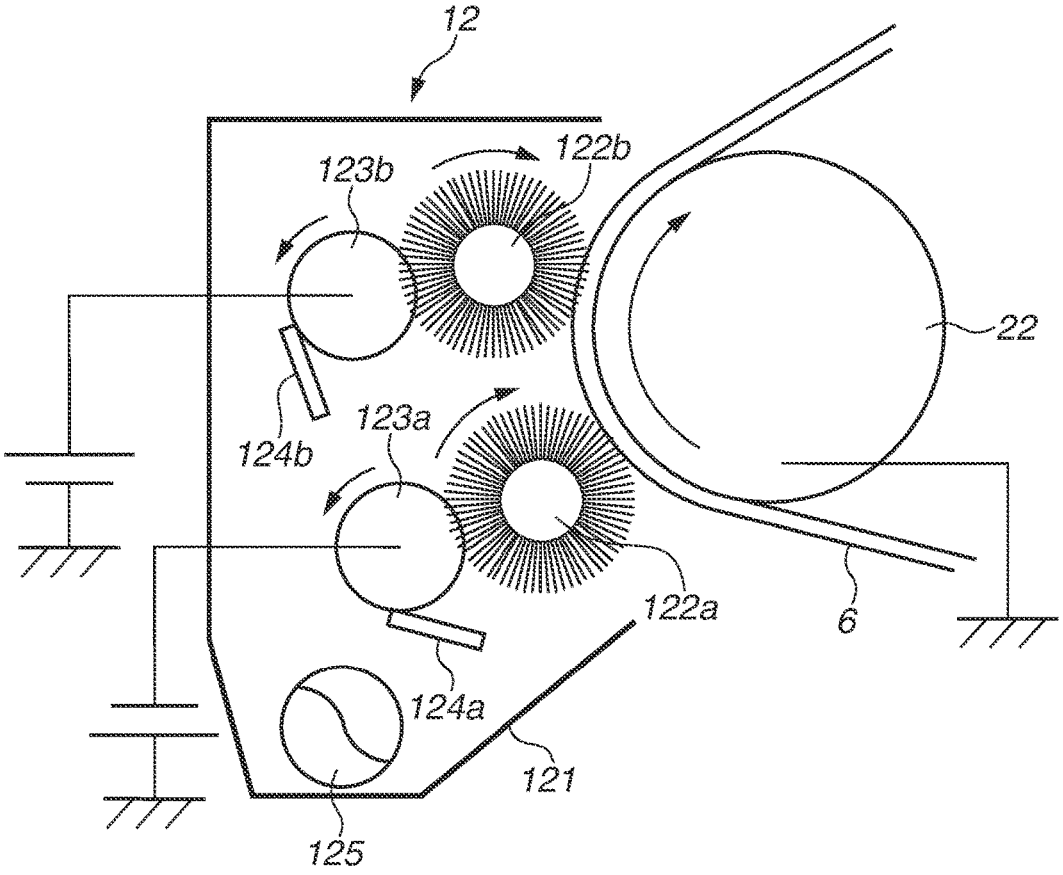
FIG. 2 is a diagram illustrating a general configuration of a belt cleaning device according to the first exemplary embodiment.

Next, the belt cleaning device 12 as the cleaning unit is described using FIG. 2. Downstream of the secondary transfer portion T2 and upstream of the primary transfer portion T1Y in the rotational direction of the intermediate transfer belt 6, the belt cleaning device 12 is placed such that the belt cleaning device faces the driving roller 22 through the intermediate transfer belt 6. Then, a cleaning voltage is applied to the belt cleaning device 12, whereby the belt cleaning device 12 cleans the surface of the intermediate transfer belt 6. That is, the belt cleaning device 12 cleans the intermediate transfer belt 6 by electrostatically collecting secondary transfer residual toner on the intermediate transfer belt 6. The cleaned intermediate transfer belt 6 is repeatedly used for image forming processes.

In the present exemplary embodiment, an electrostatic brush cleaning device is used as the belt cleaning device 12. The belt cleaning device 12 includes a device housing 121, bristle brushes 122*a* and 122*b*, metal rollers 123*a* and 123*b*, cleaning blades 124*a* and 124*b*, and a conveying screw 125. The device housing 121 is placed near the intermediate transfer belt 6. Then, the bristle brushes 122*a* and 122*b*, the metal rollers 123*a* and 123*b*, the cleaning blades 124*a* and 124*b*, and the conveying screw 125 are provided within the device housing 121.

Each of the bristle brushes 122*a* and 122*b* is a conductive bristle brush formed by embedding, on a metal roller, carbon-dispersed nylon fibers, acrylic fibers, or polyester fibers having a thread resistance value of 3E+5 to 1E+13 Ω/cm and a fiber thickness of 2 to 15 deniers. The embedding density of the bristle brush is 50,000 to 500,000 fibers/inch$^2$.

The metal rollers 123*a* and 123*b* are aluminum rollers and placed to enter the bristle brushes 122*a* and 122*b*, respectively, by predetermined entry amounts. The cleaning blades 124*a* and 124*b* are placed in contact with the metal rollers 123*a* and 123*b*, respectively.

The bristle brushes 122*a* and 122*b* are placed in sliding contact with the intermediate transfer belt 6 by maintaining entry amounts of about 1.0 to 2.0 mm and formed to pivot in the directions of arrows at speeds of 20 to 80% of the conveying speed of the intermediate transfer belt 6 by driving motors (not illustrated). The metal rollers 123*a* and 123*b* are placed by maintaining entry amounts of 1.5 to 2.5 mm with respect to the bristle brushes 122*a* and 122*b* and placed to rotate in the directions of arrows at speeds equivalent to those of the bristle brushes 122*a* and 122*b*. Each of the cleaning blades 124*a* and 124*b* is a plate made of rubber such as urethane and has a thickness of 1.6 to 2.2 mm and an International Rubber Hardness Degrees (IRHD) hardness of 70° to 78° (23° C., an RH of 50%). Then, the cleaning blades 124*a* and 124*b* are placed by maintaining entry amounts of 0.5 to 2.0 mm with respect to the metal rollers 123*a* and 123*b*.

To the metal roller 123*a* of the bristle brush 122*a*, which is located on the upstream side in the rotational direction of the intermediate transfer belt 6, a direct current voltage controlled at a constant current having a negative polarity is applied from a direct-current power supply. In the present exemplary embodiment, the current value of this constant current is −55 μA. On the other hand, to the metal roller 123*b* of the bristle brush 122*b*, which is located on the downstream side in the rotational direction of the intermediate transfer belt 6, a direct current voltage controlled at a constant current having a positive polarity is applied from the direct-current power supply. In the present exemplary embodiment, the current value of this constant current is +35 μA.

The belt cleaning device 12 forms, between the bristle brushes 122*a* and 122*b* and the intermediate transfer belt 6, a cleaning electric field suitable for toner to be thus cleaned. Then, the belt cleaning device 12 causes the bristle brushes 122*a* and 122*b* to adsorb and remove transfer residual toner on the intermediate transfer belt 6. The toner adsorbed and removed by the bristle brushes 122*a* and 122*b* is further transferred from the bristle brushes 122*a* and 122*b* onto the metal rollers 123*a* and 123*b* by the electric field. The toner transferred onto the metal rollers 123*a* and 123*b* is scraped off by the cleaning blades 124*a* and 124*b*, accumulated in the device housing 121, and conveyed to a collection container (not illustrated) by the conveying screw 125.

[Opposing Electrode]

Figure 3:
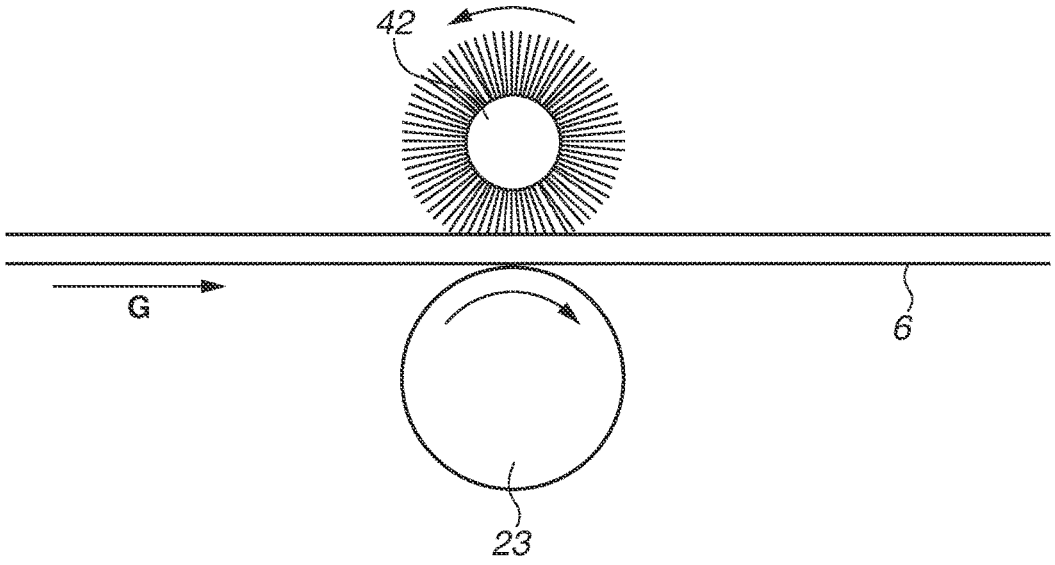
FIG. 3 is a diagram illustrating a general configuration of an opposing electrode according to the first exemplary embodiment.

Next, the opposing electrode 42 as the electrification unit is described using FIG. 3. The opposing electrode 42 is placed upstream of the primary transfer portion T1Y and downstream of the belt cleaning device 12 in the rotational direction of the intermediate transfer belt 6. Then, the opposing electrode 42 applies a current in the opposite direction to that of the primary transfer current to the intermediate transfer belt 6. In the present exemplary embodiment, the opposing electrode 42 is placed facing the stretching roller 23 through the intermediate transfer belt 6, and a voltage described below is applied from an electrification high-voltage power supply 240 (see FIGS. 1 and 4) to the opposing electrode 42.

As will be described below, there is a case where control for applying a current from the opposing electrode 42 to the intermediate transfer belt 6 is also performed during image formation. Thus, in a case where the opposing electrode 42 is placed downstream of the primary transfer portion T1Y, the control influences a toner image primarily transferred onto the intermediate transfer belt 6. Thus, the opposing electrode 42 is placed upstream of the primary transfer portion T1Y, which is the furthest upstream. Further, in view of the influence of a toner image on the intermediate transfer belt 6, the opposing electrode 42 may only need to be placed downstream of the secondary transfer portion T2. It is, however, possible to apply a current to the surface of the intermediate transfer belt 6 more evenly in the state where the surface of the intermediate transfer belt 6 is cleaned by the belt cleaning device 12. Thus, it is desirable that the opposing electrode 42 should be placed downstream of the belt cleaning device 12.

Further, in the present exemplary embodiment, a bristle brush is used as the opposing electrode 42. The bristle brush is a conductive bristle brush formed by embedding, on a metal roller, carbon-dispersed nylon fibers, acrylic fibers, or polyester fibers having a thread resistance value of 3E+5 to 1E+9 Ω/cm and a fiber thickness of 2 to 15 deniers. The embedding density of the bristle brush is 50,000 to 500,000 fibers/inch$^2$.

The bristle brush as the opposing electrode 42 is placed by maintaining an entry amount of about 1.0 to 2.0 mm with respect to the intermediate transfer belt 6 and rotates in the direction of an arrow in FIG. 3 at a speed equivalent to the conveying speed of the intermediate transfer belt 6 by a driving motor (not illustrated).

[Control of Image Forming Apparatus]

Figure 4:
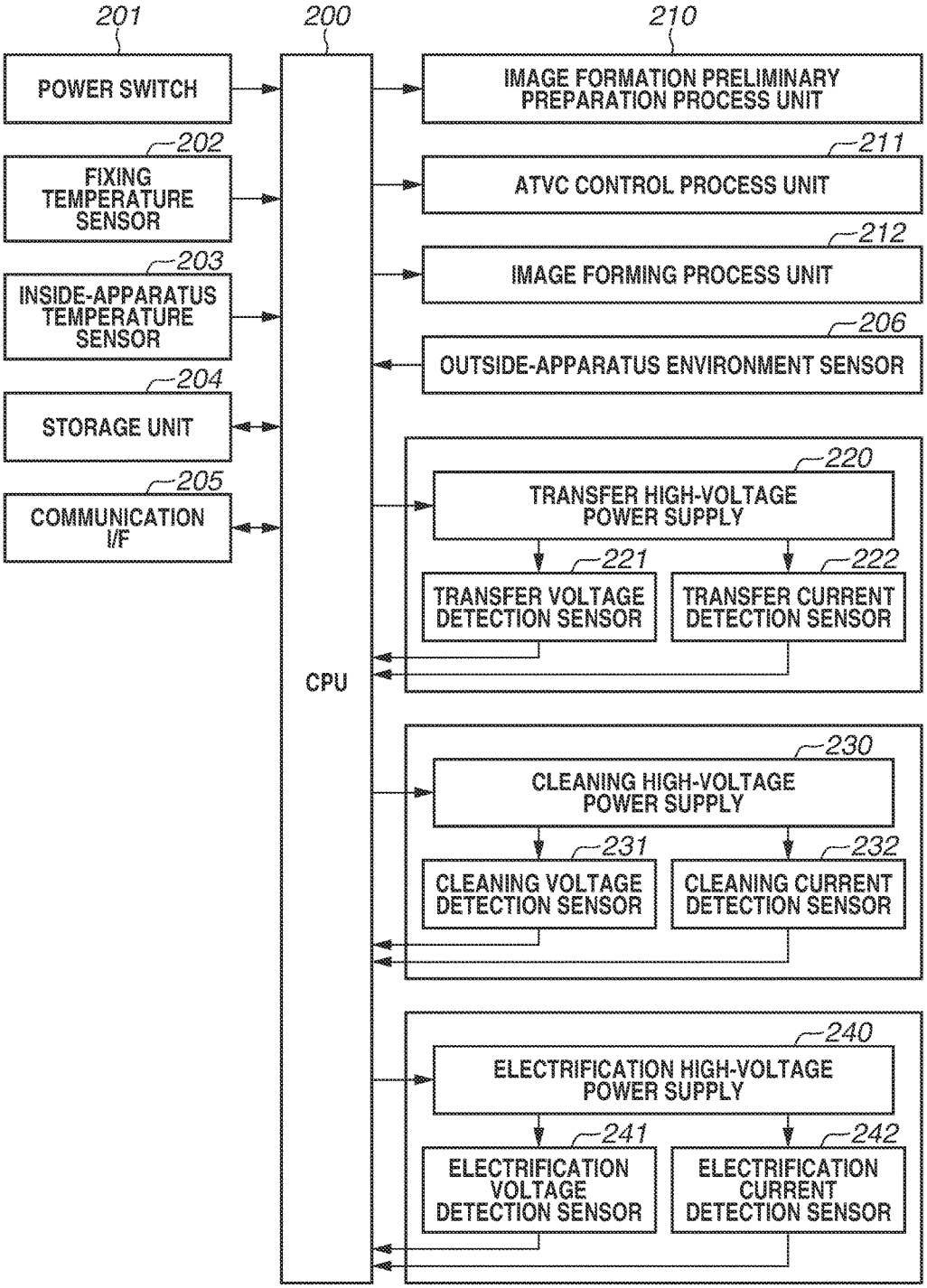
FIG. 4 is a control block diagram illustrating the image forming apparatus according to the first exemplary embodiment.

Next, the control of the image forming apparatus 100 is described using FIG. 4. A central processing unit (CPU) 200 as a control unit is connected to a power switch 201, a fixing temperature sensor 202, an inside-apparatus temperature sensor 203, a storage unit 204, a communication interface (I/F) 205, and an outside-apparatus environment sensor 206. The power switch 201 turns on and off the power supply of the image forming apparatus 100. The fixing temperature sensor 202 is placed in the fixing device 30 and detects the temperature of a fixing member for heating a toner image on the recording material S. The inside-apparatus temperature sensor 203 is placed in the main body of the image forming apparatus 100 and detects the temperature inside the main body of the apparatus (inside the apparatus).

The storage unit 204 includes a read-only memory (ROM) and a random-access memory (RAM). The ROM stores a program corresponding to a control procedure. Examples of such a program include an image formation preliminary preparation process unit 210, an active transfer voltage control (ATVC) control process unit 211, and an image forming process unit 212. The CPU 200 controls components while reading a program. The RAM stores work data and input data. Based on the above program, the CPU 200 performs control with reference to data stored in the RAM.

The communication I/F 205 communicates with the host device such as a personal computer. The outside-apparatus environment sensor 206 as a moisture amount detection unit detects the temperature and the humidity outside the apparatus around the main body of the apparatus, to detect the absolute amount of moisture in the air around the main body of the apparatus.

Further, the CPU 200 is connected to a transfer high-voltage power supply 220, a cleaning high-voltage power supply 230, and an electrification high-voltage power supply 240. The transfer high-voltage power supply 220 can apply a voltage to the primary transfer roller 5Y. The same goes for the primary transfer rollers 5M, 5C, and 5*k*. The cleaning high-voltage power supply 230 as a voltage application unit can apply a voltage to the metal roller 123*b* of the bristle brush 122*b*, which is located on the downstream side in the belt cleaning device 12. The electrification high-voltage power supply 240 can apply a voltage to the opposing electrode 42.

Further, the CPU 200 is connected to a transfer voltage detection sensor 221, a transfer current detection sensor 222, a cleaning voltage detection sensor 231, a cleaning current detection sensor 232, an electrification voltage detection sensor 241, and an electrification current detection sensor 242.

The transfer voltage detection sensor 221 detects a voltage to be applied from the transfer high-voltage power supply 220 to the primary transfer roller 5Y. The same goes for the primary transfer rollers 5M, 5C, and 5*k*. The transfer current detection sensor 222 as a current detection unit detects a current to flow through the primary transfer device, i.e., a current to flow from the primary transfer roller 5Y to the intermediate transfer belt 6. The same goes for the primary transfer devices.

The cleaning voltage detection sensor 231 detects a voltage to be applied from the cleaning high-voltage power supply 230 to the metal roller 123*b*. The cleaning current detection sensor 232 detects a current to flow from the bristle brush 122*b* to the intermediate transfer belt 6. The electrification voltage detection sensor 241 detects a voltage to be applied from the electrification high-voltage power supply 240 to the opposing electrode 42. The electrification current detection sensor 242 detects a current to flow from the opposing electrode 42 to the intermediate transfer belt 6.

[ATVC and Sheet-to-Sheet Interval Voltage Correction]

Figure 5:
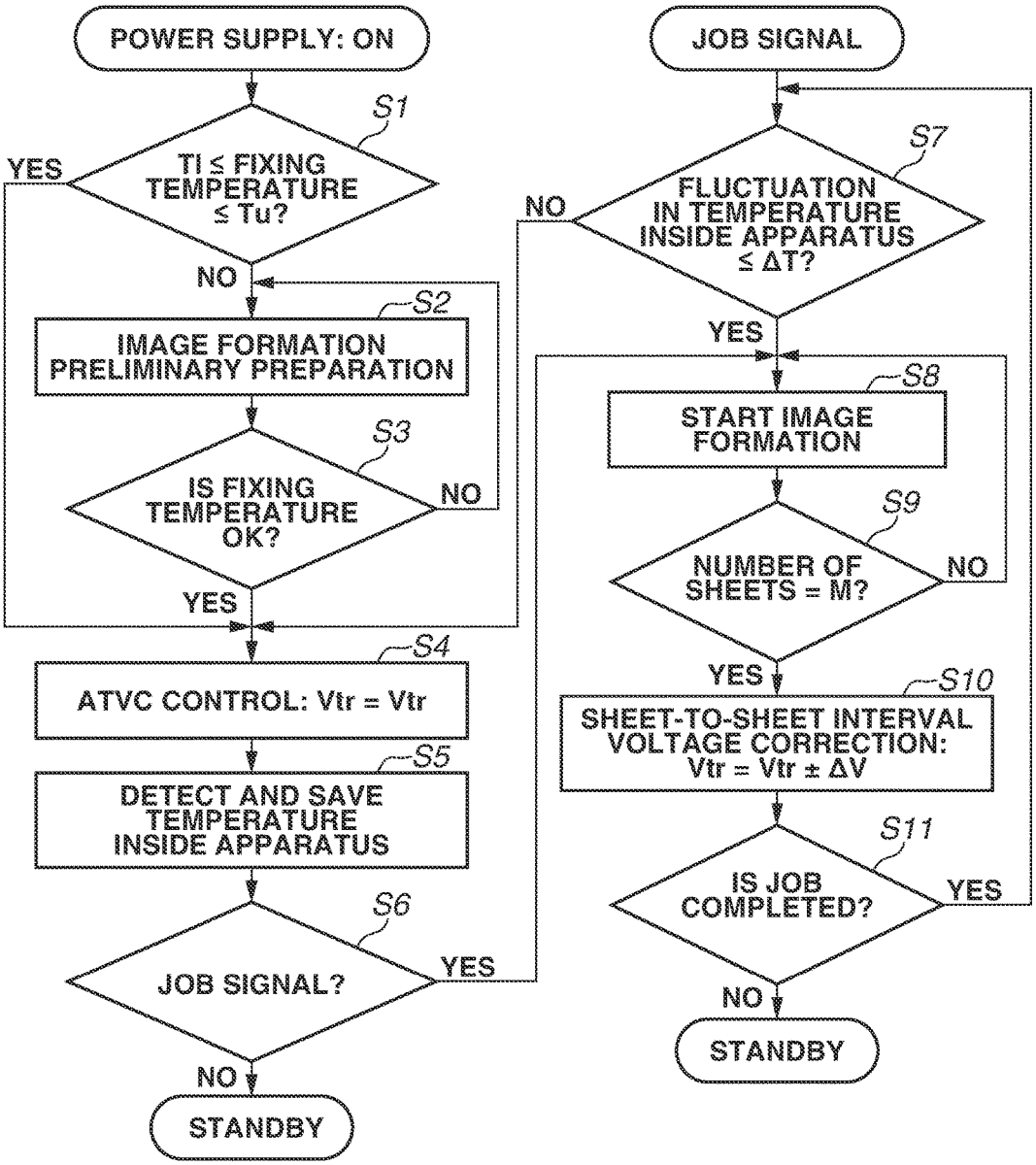
FIG. 5 is a flowchart illustrating control of active transfer voltage control (ATVC) and sheet-to-sheet interval voltage correction.
Figure 6:
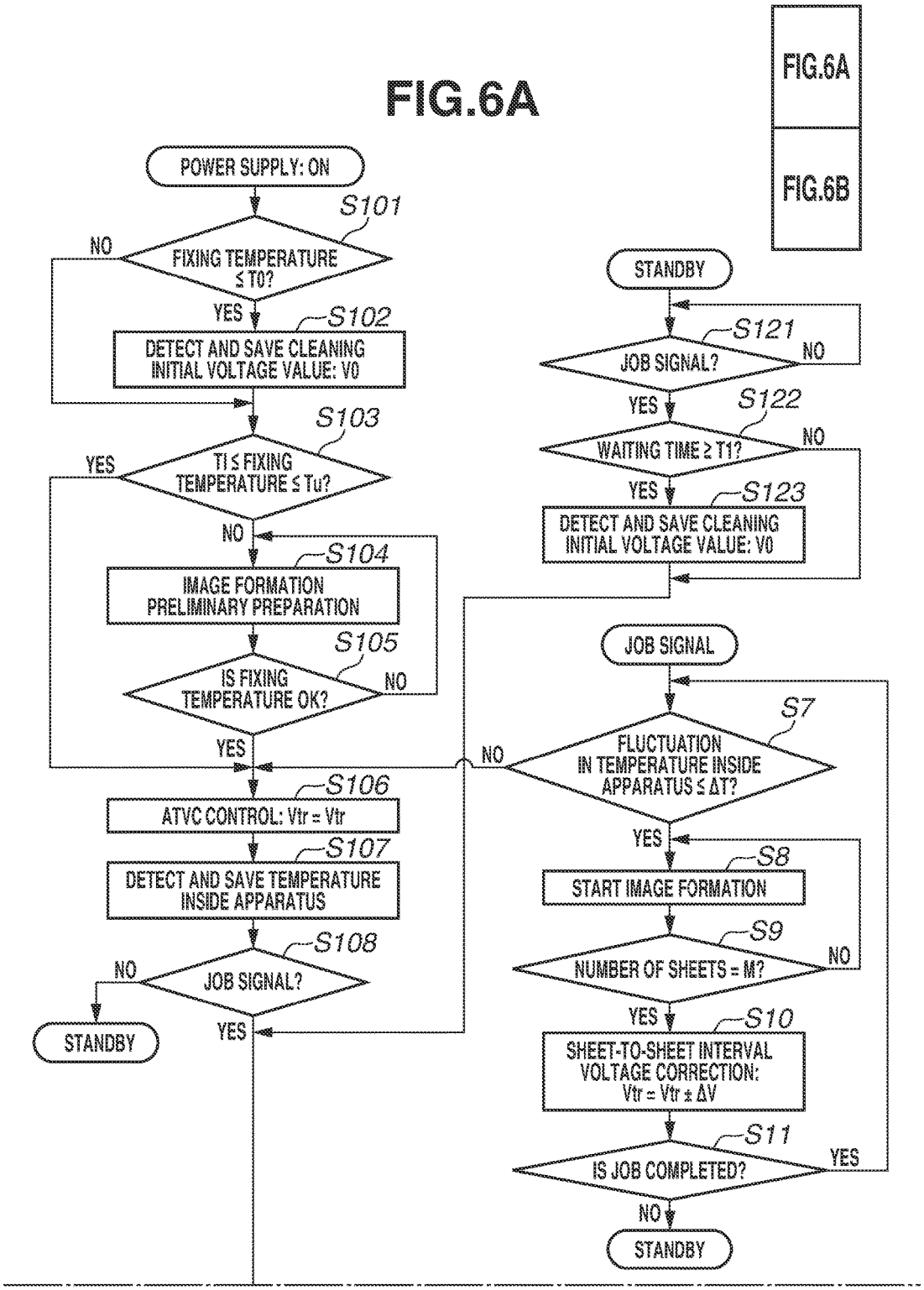
FIG. 6, including

Next, control of ATVC and sheet-to-sheet interval voltage correction performed in the present exemplary embodiment is described using FIG. 5. To describe the control of ATVC and sheet-to-sheet interval voltage correction, FIG. 5 particularly extracts and illustrates this control. In the present exemplary embodiment, control as illustrated in FIG. 6 is performed.

First, the reason for performing ATVC is described. If image formation is performed, the intermediate transfer belt 6 has many electrified portions. Thus, the resistance of the intermediate transfer belt 6 increases, and an optimal transfer current does not flow through the intermediate transfer belt 6 at a transfer voltage set before the image formation. Thus, in the present exemplary embodiment, as will be described below, control for correcting the transfer voltage during the image formation (sheet-to-sheet interval voltage correction) is performed. If, however, the image formation ends, and the intermediate transfer belt 6 is left in a non-electrified state, the resistance of the intermediate transfer belt 6 having increased during the image formation relaxes to return to the previous resistance.

Such a phenomenon is conspicuous in a case where the intermediate transfer belt 6 has a plurality of layers such as a base material, an elastic layer, and a surface layer, particularly in a case where an ion conductive material is used to adjust the resistance of the elastic layer, as in the present exemplary embodiment. An ion conductive material is effective in remedying uneven resistance, but tends to cause such a phenomenon.

Thus, when an image forming operation for a next image forming job is performed, and if a transfer voltage applied when the last image forming operation for the previous image forming job is performed is used, a transfer current increases by an amount corresponding to a decrease in the resistance of the intermediate transfer belt 6. As a result, a phenomenon where a toner image cannot be appropriately transferred occurs. In response, a pre-process for detecting a transfer voltage for applying an appropriate transfer current, i.e., transfer voltage setting control, is performed immediately before the start of an image forming operation. Specifically, the CPU 200 can execute ATVC before an image forming operation.

ATVC is the mode of setting a voltage to be applied to the primary transfer roller 5Y when image formation is performed. Specifically, first, voltages at a plurality of steps are applied from the transfer high-voltage power supply 220 to the primary transfer roller 5Y, and the transfer current detection sensor 222 detects current values at the respective voltages. Then, based on the voltages at the plurality of steps and the current values detected by the transfer current detection sensor 222, a transfer voltage to be applied to the primary transfer roller 5Y when image formation is performed is set. That is, from the voltages applied at the plurality of steps and the current values detected at the respective voltages, the relationships between the voltages and the currents are obtained, and the transfer voltage is set to achieve a target current value.

After such ATVC in a pre-process is executed, a transfer current is detected during the image formation, and the transfer voltage is corrected so that an optimal transfer current flows (sheet-to-sheet interval voltage correction). That is, the CPU 200 can detect a current value using the transfer current detection sensor 222 during the execution of an image forming job. Then, based on the detected current value, the CPU 200 can change a voltage to be applied to the primary transfer roller 5Y during the execution of the image forming job. Consequently, an optimal transfer voltage is maintained in response to even an increase in the resistance of the intermediate transfer belt 6 during image formation. The same goes for the primary transfer rollers 5M, 5C, and 5*k*.

An image forming job corresponds to the period from the start of image formation to the completion of the image formation based on a print signal (an image forming signal) for forming an image on the recording material S. That is, an image forming job corresponds to the period in which, according to the input of an image forming signal, a series of operations including a pre-operation (pre-rotation and image formation preliminary preparation) to be performed before an image forming operation, the image forming operation, and a post-operation (post-rotation) to be performed after the image forming operation is performed.

More specifically, an image forming job corresponds to the period from pre-rotation after the reception of a print signal (the input of an image forming job) to post-rotation, and corresponds to the period including the period of an image forming operation and a sheet-to sheet interval (when image formation is not performed). Further, pre-rotation corresponds to the period in which, as a preparation operation before an image forming operation, the rotation of the photosensitive drums 1Y, 1M, 1C, and 1*k* is started, various voltages are sequentially raised, and the various voltages are adjusted. An image forming operation corresponds to the period in which an image to be formed on the recording material S is actually formed. Post-rotation corresponds to the period in which, as an operation after an image forming operation, various voltages are sequentially dropped while continuing the rotation of the photosensitive drums 1Y, 1M, 1C, and 1*k*, and ultimately, the rotation of the photosensitive drums 1Y, 1M, 1C, and 1*k* is stopped. A sheet-to-sheet interval corresponds to the period corresponding to the interval between recording materials successively passing through the transfer unit.

An example of the above control of ATVC and sheet-to-sheet interval voltage correction is described using FIG. 5 with reference to FIGS. 1 and 4. If the power switch 201 is turned on, then in step S1, the CPU 200 reads the detected value of the fixing temperature sensor 202 and determines whether a fixing temperature is within the range of Tl to Tu (Tl or more and Tu or less). For example, Tl=160° C., and Tu=180° C. The values of Tl and Tu can be appropriately set. In a case where the fixing temperature is outside this range (NO in step S1), the processing proceeds to step S2. In step S2, the CPU 200 inputs an execution signal to the image formation preliminary preparation process unit 210 to start image formation preliminary preparation. In step S3, during the image formation preliminary preparation, the CPU 200 reads the detected value of the fixing temperature sensor 202. In a case where the fixing temperature falls within the range of Tl to Tu, the CPU 200 determines that the fixing temperature is within an appropriate range (YES in step S3). In step S4, the CPU 200 performs ATVC which is described below. In a case where, on the other hand, the fixing temperature is within the range of Tl to Tu in step S1 (YES in step S1), the CPU 200 does not execute image formation preliminary preparation, the processing proceeds to step S4, and then the CPU 200 executes the ATVC.

In step S4, in the ATVC, the CPU 200 inputs a signal to the ATVC control process unit 211 and charges the photosensitive drums 1Y, 1M, 1C, and 1*k* similarly to the image forming process. Next, the CPU 200 applies voltages at a plurality of levels to the primary transfer rollers 5Y, 5M, 5C, and 5*k* and detects currents at this time. Based on the relationships between the voltages and the currents, the CPU 200 determines a transfer voltage Vtr to achieve a target current value to be output. At this time, in step S5, the CPU 200 detects the temperature inside the apparatus using the inside-apparatus temperature sensor 203 and stores the temperature inside the apparatus in the storage unit 204. Next, in a case where a job signal (an image forming signal) is not input (NO in step S6), the CPU 200 enters a standby state and waits for a job signal. In a case where, on the other hand, a job signal is input (YES in step S6), the processing proceeds to step S8. In step S8, the CPU 200 inputs a signal to the image forming process unit 212 to start image formation.

A description is given of an operation to be performed when a job signal is input after the CPU 200 enters the standby state. In a case where a job signal is input in the standby state, then in step S7, the CPU 200 detects the temperature inside the apparatus using the inside-apparatus temperature sensor 203 and determines whether the difference between the detected temperature and the temperature inside the apparatus stored and saved in the storage unit 204 after the ATVC is performed in step S5 is ΔT or less. For example, ΔT=2° C. However, ΔT can be appropriately set. In a case where the difference between the detected temperature and the temperature inside the apparatus stored and saved in the storage unit 204 is greater than ΔT (NO in step S7), the processing returns to step S4, and the CPU 200 executes ATVC again.

In a case where, on the other hand, the difference between the detected temperature and the temperature inside the apparatus stored and saved in the storage unit 204 is ΔT or less (YES in step S7), the processing proceeds to step S8. In step S8, the CPU 200 inputs a signal to the image forming process unit 212 to start image formation. After the image formation is started, then in step S9, the CPU 200 detects primary transfer currents corresponding to M sheet-to-sheet intervals using the transfer current detection sensor 222 and stores the primary transfer currents in the storage unit 204. Then, the CPU 200 performs an average calculation process for calculating the average of the detected current values. In step S10, the CPU 200 compares the current obtained by the average process with the target current. If the difference between these currents is outside a predetermined range, the CPU 200 corrects the transfer voltage Vtr (sheet-to-sheet interval voltage correction).

The target current value is 40 μA, for example, but can be appropriately set. Further, the predetermined range of the difference between the currents is ±2 μA, but can be appropriately set. That is, in a case where the current obtained by the average process is greater than the target current value by more than 2 μA, the CPU 200 lowers the transfer voltage Vtr by ΔV. In a case where, on the other hand, the current obtained by the average process is smaller than the target current value by more than 2 μA, the CPU 200 raises the transfer voltage Vtr by ΔV. ΔV is 25 V, for example, but can be appropriately set.

During image formation, currents continuously flow from the primary transfer rollers 5Y, 5M, 5C, and 5K in the thickness direction of the intermediate transfer belt 6 (in the directions from the primary transfer rollers 5Y, 5M, 5C, and 5K to the photosensitive drums 1Y, 1M, 1C, and 1*k*). Thus, the resistance of the intermediate transfer belt 6 is likely to increase. Accordingly, in the sheet-to-sheet interval voltage correction, an adjustment is made to raise the transfer voltage Vtr by ΔV. The setting range of the primary transfer voltage is 0.5 to 3.7 kV, for example. Then, in step S11, in a case where an image forming job is completed (YES in step S11), the CPU 200 enters a standby state again.

The number of sheet-to-sheet intervals M in which the above sheet-to-sheet interval voltage correction is performed is M=5×N+1 (N is a natural number), for example. Every five sheet-to-sheet intervals, the average current of the sheet-to-sheet intervals is calculated. Then, when the subsequent image formation is performed, ΔV is added to or subtracted from the transfer voltage Vtr up to this time according to the sheet-to-sheet intervals, thereby correcting the voltage. The timing for performing this sheet-to-sheet interval voltage correction is not limited to this. For example, every 10 sheet-to-sheet intervals, the average current of the sheet-to-sheet intervals may be calculated, such as M=10×N+1. Then, when the subsequent image formation is performed, the transfer voltage Vtr may be corrected.

[Electrification Control]

Next, electrification control for controlling the electrification of the intermediate transfer belt 6 by the opposing electrode 42 serving as the electrification unit is described using FIGS. 6A to 8D with reference to FIGS. 1 to 4. As described above, if ATVC is performed in a pre-process immediately before the start of image formation, the time from the input of an image formation start signal to the output of an image becomes long, and productivity decreases. Thus, it is desirable to reduce the execution frequency of ATVC. In response, in the present exemplary embodiment, to improve a decrease in productivity due to an increase in the resistance of the intermediate transfer belt 6, the electrification of the intermediate transfer belt 6 by the opposing electrode 42 is controlled as described below.

The opposing electrode 42 is placed upstream of the primary transfer portion T1Y and downstream of the belt cleaning device 12 in the rotational direction (the moving direction) of the intermediate transfer belt 6 and applies, to the intermediate transfer belt 6, a current in the opposite direction to that of the primary transfer current. In the case of the intermediate transfer belt 6 using an ion conductive agent, the ion conductive agent segregates (is localized) due to the primary transfer current flowing through the intermediate transfer belt 6 during image formation. Then, the resistance of the intermediate transfer belt 6 increases. Thus, in the present exemplary embodiment, to reduce this segregation, a current in the opposite direction to that of the primary transfer current is applied from the opposing electrode 42 to the intermediate transfer belt 6.

In the case of the present exemplary embodiment, the opposing electrode 42 is placed in contact with the outer peripheral surface of the intermediate transfer belt 6, and the electrification high-voltage power supply 240 applies a voltage to the opposing electrode 42, whereby a current having a positive polarity flows from the outer peripheral surface to the inner peripheral surface of the intermediate transfer belt 6. On the inner peripheral surface of the intermediate transfer belt 6 and at a position facing the opposing electrode 42 through the intermediate transfer belt 6, the stretching roller 23, which is grounded, is provided.

In the present exemplary embodiment, according to the relationship between a voltage to be applied from the cleaning high-voltage power supply 230 and a current to flow through the intermediate transfer belt 6 in a case where this voltage is applied, the CPU 200 controls the amount of current to be applied from the opposing electrode to the intermediate transfer belt 6. That is, the cleaning high-voltage power supply 230 can apply a voltage so that a predetermined current (e.g., +35 μA) flows from the bristle brush 122*b*, which is on the downstream side, to the intermediate transfer belt 6. Then, according to the output (the voltage) of the cleaning high-voltage power supply 230 to be applied so that the predetermined current flows, the CPU 200 controls the amount of current to be applied from the opposing electrode 42 to the intermediate transfer belt 6.

Specifically, the CPU 200 applies a voltage to the cleaning high-voltage power supply 230 so that a predetermined current flows at a predetermined timing. The voltage of the cleaning high-voltage power supply 230 at this time is a first output V0. Further, the CPU 200 applies a voltage to the cleaning high-voltage power supply 230 so that a predetermined current flows during the execution of an image forming job after the predetermined timing. The voltage of the cleaning high-voltage power supply 230 at this time is a second output V1. Then, according to the difference between the first output V0 and the second output V1, the CPU 200 controls the amount of current Ir to be applied from the opposing electrode 42 to the intermediate transfer belt 6.

At this time, the predetermined timing is any time before the start of image formation for the first image forming job input after the power supply of the apparatus is turned on after a predetermined time or more elapses since the power supply of the apparatus is turned off. Alternatively, the predetermined timing is any time before the start of image formation for the first image forming job input after a predetermined time or more elapses in a waiting state (a standby state) where the CPU 200 waits for the input of an image forming job after the power supply of the apparatus is turned on.

That is, the predetermined timing is the time when a sufficient time (a predetermined time or more, such as 30 minutes or more) elapses after the completion of a previous image forming job, and the resistance of the intermediate transfer belt 6 having increased during the image formation decreases and becomes stable. The determination of whether the predetermined time or more elapses since the power supply of the apparatus is turned off may be made by counting time or by, for example, determining whether the fixing temperature is brought to a predetermined temperature T0 or less. This method can be used because in a case where a previous image forming job is completed, and the power supply is turned off, the fixing temperature gradually decreases with the lapse of time. Thus, it is possible to estimate the lapse of time from the fixing temperature.

In the present exemplary embodiment, constant current control is performed so that a predetermined current flows from the bristle brush 122*b* to the intermediate transfer belt 6. The cleaning voltage detection sensor 231 detects the voltage of the cleaning high-voltage power supply 230 at this time, whereby the first output V0 and the second output V1 are obtained. That is, the first output V0 detected at a predetermined timing is set as a reference voltage, and based on the difference between the first output V0 and the second output V1, which is detected during the execution of an image forming job after the predetermined timing, a current to be applied from the opposing electrode 42 to the intermediate transfer belt 6 is determined. The second output V1 is detected as needed or at predetermined intervals (e.g., every sheet-to-sheet interval, or every time a predetermined number of images are formed) during the execution of the image forming job, and the CPU 200 appropriately changes the current to be applied from the opposing electrode 42 to the intermediate transfer belt 6.

Specifically, in a case where the difference between the first output V0 and the second output V1 is less than a threshold (V1−V0<Vs), the CPU 200 applies a current having a first current value I1 from the opposing electrode 42 to the intermediate transfer belt 6. In a case where, on the other hand, the difference is the threshold or more (V1−V0≥Vs), the CPU 200 applies a current having a second current value I2, which is greater in absolute value than the first current value I1, from the opposing electrode 42 to the intermediate transfer belt 6. The first current value I1 may be 0 μA. That is, in a case where the difference is less than the threshold, the CPU 200 may not apply a current from the opposing electrode 42 to the intermediate transfer belt 6. In a case where the difference is the threshold or more, the CPU 200 may apply a current from the opposing electrode 42 to the intermediate transfer belt 6.

At this time, the first output V0 is the voltage of the cleaning high-voltage power supply 230 in the state where the resistance of the intermediate transfer belt 6 is stable. The second output V1 is the voltage of the cleaning high-voltage power supply 230 when the resistance of the intermediate transfer belt 6 increases due to image formation. Thus, the greater the difference between the first output V0 and the second output V1, the more the resistance of the intermediate transfer belt 6 increases. Thus, in a case where the difference is the threshold Vs or more, i.e., the difference is great, it is possible to determine that the resistance of the intermediate transfer belt 6 increases. Therefore, the current value of a current to be applied from the opposing electrode 42 to the intermediate transfer belt 6 is made great and, as a result, the resistance of the intermediate transfer belt 6 is restored to the state where V0 is detected, or a state close to this state.

If the resistance of the intermediate transfer belt 6 is thus restored, and even if ATVC is not executed when the subsequent image formation is started, it is possible to reduce the occurrence of a transfer failure even by using a transfer voltage set when the previous image forming job is completed. That is, the above control is executed, whereby it is possible to control the amount of current to be applied from the opposing electrode 42, according to a change in the resistance of the intermediate transfer belt 6. Thus, even when an image forming job is completed, an increase in the resistance of the intermediate transfer belt 6 is suppressed. Then, even if the primary transfer voltage is changed by performing the control of sheet-to-sheet interval voltage correction, the primary transfer voltage does not greatly increase from when the image forming job is started.

Thus, even if the time until the start of a next image forming job is long, and the resistance of the intermediate transfer belt 6 relaxes, the resistance value does not greatly change from when the previous image forming job is completed. Thus, even if the primary transfer voltage set last in the previous image forming job is used when the next image forming job is started, it is possible to prevent the primary transfer current from flowing excessively and reduce the occurrence of a transfer failure without executing ATVC. As a result, it is possible to reduce the execution frequency of ATVC and improve productivity.

Figure 6B:
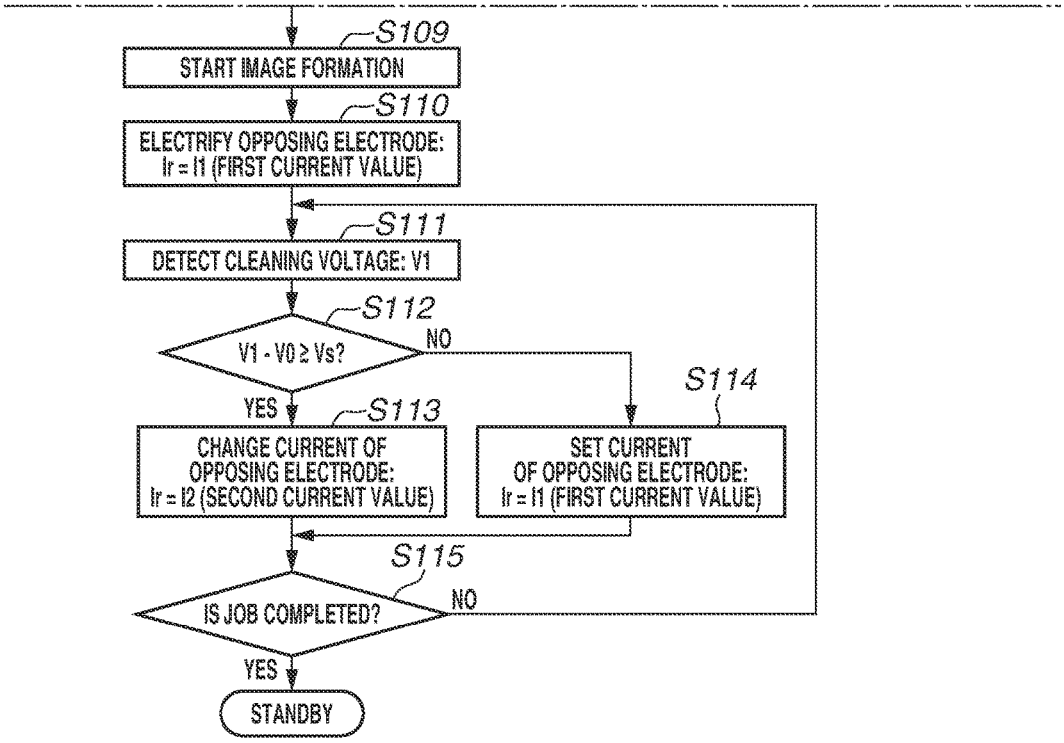

An example of the electrification control according to the present exemplary embodiment as described above is described using FIGS. 6A and 6B. The description of steps in a flowchart in FIGS. 6A and 6B that are similar to those in the flowchart in FIG. 5 is simplified. If the power switch 201 is turned on, then in step S101, the CPU 200 determines whether a fixing temperature is a predetermined temperature T0 or less. In the present exemplary embodiment, T0=100° C. However, T0 can be appropriately set. In the present exemplary embodiment, the predetermined temperature T0 is set such that the time in which the intermediate transfer belt 6 is left without being electrified in the state where the power supply remains off is 30 minutes or more. In a case where the fixing temperature is T0 or less in step S101 (YES in step S101), the CPU 200 drives the intermediate transfer belt 6 to rotate. Then, in step S102, the CPU 200 detects a cleaning initial voltage value (first output) V0 of a voltage to be applied to apply a current of +35 μA controlled at a constant current to the metal roller 123*b* of the bristle brush 122*b*, and saves the cleaning initial voltage value V0 in the storage unit 204.

Next, in step S103, the CPU 200 reads the detected value of the fixing temperature sensor 202 and determines whether the fixing temperature is within the range of Tl to Tu (Tl or more and Tu or less). For example, Tl=160° C., and Tu=180° C. In a case where the fixing temperature is outside this range (NO in step S103), the processing proceeds to step S104. In step S104 the CPU 200 starts image formation preliminary preparation. In step S105, during the image formation preliminary preparation, the CPU 200 reads the detected value of the fixing temperature sensor 202. In a case where the fixing temperature falls within the range of Tl to Tu, the CPU 200 determines that the fixing temperature is within an appropriate range (YES in step S105). In step S106, the CPU 200 performs ATVC to set a primary transfer voltage Vtr. In a case where, on the other hand, the fixing temperature is within the range of Tl to Tu in step S103 (YES in step S103), the CPU 200 does not execute image formation preliminary preparation, and the processing proceeds to step S106. In step S106, the CPU 200 executes ATVC. At this time, in step S107, the CPU 200 detects the temperature inside the apparatus using the inside-apparatus temperature sensor 203 and stores the temperature inside the apparatus in the storage unit 204.

In a case where the fixing temperature is higher than T0 in step S101 (NO in step S101), the CPU 200 determines that the time in which the intermediate transfer belt 6 is left without being electrified is less than 30 minutes. Then, the CPU 200 does not update the cleaning initial voltage V0, and the processing proceeds to step S103. Then, in S103 to S107, similarly, the CPU 200 performs ATVC, and the CPU 200 detects, stores, and saves the temperature inside the apparatus. After step S107, then in step S108, the CPU 200 enters a waiting state (a standby state) where the CPU 200 waits for the input of a job signal. Steps S103 to S107 are similar to steps S1 to S5 in FIG. 5.

In step S108, in a case where the CPU 200 does not enter a standby state, and a job signal is input (YES in step S108), the processing proceeds to step S109. In step S109, image formation is immediately started. In a case where, on the other hand, a job signal is not input in step S108 (NO in step S108), and the CPU 200 enters a standby state, the processing proceeds to the upper right of the flowchart in FIG. 6A. In a case where a job signal is input in the standby state where the CPU 200 waits for a job signal (YES in step S121), then in step S122, the CPU 200 determines whether a waiting time in which the CPU 200 waits for a job signal is T1 or more. In the present exemplary embodiment, T1=30 minutes. The present exemplary embodiment, however, is not limited to this. In a case where a job signal is input in the standby state (YES in step S121), and the waiting time is T1 or more (YES in step S122) before image formation is started in step S109, the CPU 200 drives the intermediate transfer belt 6 to rotate. Then, in step S123, the CPU 200 detects the cleaning initial voltage value (first output) V0 of a voltage to be applied to apply a current of +35 μA controlled at a constant current to the metal roller 123*b* of the bristle brush 122*b*, and saves the cleaning initial voltage value V0 in the storage unit 204. That is, the CPU 200 updates V0.

If image formation is started in step S109, then in step S110, the CPU 200 applies a current having a first current value I1, as a current Ir with which to electrify the opposing electrode 42. In the present exemplary embodiment, I1 is set to +1 to +20 μA. The present exemplary embodiment, however, is not limited to this. Alternatively, the electrification high-voltage power supply 240 may be turned off to ground the opposing electrode 42. Further, if a job signal is input, then as illustrated on the right of the flowchart in FIGS. 6A and 6B, the control of sheet-to-sheet interval voltage correction (steps S7 to S11) is executed in parallel with control in and after step S109. This control of sheet-to-sheet interval voltage correction is as described in FIG. 5.

After step S110, then in step S111, the CPU 200 detects a cleaning voltage (second output) V1 controlled at a constant current to achieve a predetermined current. In the present exemplary embodiment, V1 is a voltage to be applied to apply a current of +35 μA (the predetermined current) controlled at a constant current and is +0.05 to +5 kV. Next, in step S112, the CPU 200 determines whether the difference (V1−V0) between the cleaning initial voltage value (first output) V0 and the cleaning voltage (second output) V1 is a threshold Vs or more. In a case where V1−V0 is Vs or more (YES in step S112), then in step S113, the CPU 200 changes the current Ir with which to electrify the opposing electrode 42 to a second current value I2. In a case where, on the other hand, V1−V0 is less than Vs (NO in step S112), then in step S114, the CPU 200 sets the current Ir with which to electrify the opposing electrode 42 to the first current value I1. The control in steps S111 to S114 is performed during the execution of an image forming job, i.e., until the job is completed. In a case where the job is completed (YES in step S115), the CPU 200 enters a standby state.

In the case of the present exemplary embodiment, the threshold Vs can be changed according to the absolute amount of moisture around the apparatus (outside the apparatus). That is, as described above, the CPU 200 can detect the absolute amount of moisture outside the apparatus using the outside-apparatus environment sensor 206 as the moisture amount detection unit, and according to the detected absolute amount of moisture, can change the threshold Vs as illustrated in FIG. 7. Further, in the case of the present exemplary embodiment, as illustrated in FIG. 7, the CPU 200 can also change the second current value I2 according to the detected absolute amount of moisture.

That is, if the absolute amount of moisture is a first amount of moisture, the threshold Vs is set to a first threshold. If the absolute amount of moisture is a second amount of moisture greater than the first amount of moisture, the threshold Vs is set to a second threshold greater than the first threshold. Similarly, if the absolute amount of moisture is a third amount of moisture, the second current value I2 is set to a first value. If the absolute amount of moisture is a fourth amount of moisture greater than the third amount of moisture, the second current value I2 is set to a second value greater in absolute value than the first value.

The reason why the threshold Vs for switching the current Ir of the opposing electrode 42 from the first current value I1 to the second current value I2 is variable according to the absolute amount of moisture of the environment outside the apparatus is as follows. As described above, to reduce the segregation of the ion conductive agent of the intermediate transfer belt 6, a current having the second current value I2 is applied from the opposing electrode 42. However, it takes more time for this reduction to proceed on a low-humidity side. Thus, on the low-humidity side, i.e., in a case where the absolute amount of moisture is small, the threshold Vs is made small so as to switch the current Ir from the first current value I1 to the second current value I2 earlier and restoring the resistance of the intermediate transfer belt 6 earlier. At this time, an increase in the resistance of the intermediate transfer belt 6 is considered to be small. Thus, the second current value I2 is made small.

On the other hand, on a high-humidity side, i.e., in a case where the absolute amount of moisture is great, the resistance of the intermediate transfer belt 6 is quickly restored based on the second current value I2 of a current to be applied from the opposing electrode 42. Thus, the restoration of the resistance of the intermediate transfer belt 6 in the state where the intermediate transfer belt 6 is left without being electrified (e.g., while the CPU 200 waits for a job) is also promoted. Thus, even if the current Ir is switched to the second current value I2 late, i.e., even if the threshold Vs is not made small, it is possible to restore the resistance of the intermediate transfer belt 6 relatively early. However, since the resistance of the intermediate transfer belt 6 still increases, the second current value I2 is heightened to optimize the restoration of the resistance. In other words, if the absolute amount of moisture is great, the segregation of the ion conductive material is quickly reduced. Thus, the segregation is immediately reduced only by making the second current value I2 great. Thus, it is possible to make the resistance of the intermediate transfer belt 6 appropriate before a toner image is primarily transferred from the photosensitive drum 1Y onto the intermediate transfer belt 6.

As described above, in the present exemplary embodiment, according to the output of the cleaning high-voltage power supply 230, a current to be applied from the opposing electrode 42 to the intermediate transfer belt 6 is switched between the first current value I1 and the second current value I2. Consequently, even if, as the primary transfer voltage Vtr during image formation for a next job (during the execution of a next image forming job), the last voltage set in the previous job is used without executing ATVC, it is possible to reduce a fluctuation in the primary transfer current.

A description is given of the result of examining the primary transfer current when image formation for a next job is performed using the setting value of the last primary transfer voltage in the previous image forming job, in each of a case where the control according to the present exemplary embodiment as described above is performed, and a case where the control is not performed. FIGS. 8A to 8D illustrate the case where the control according to the present exemplary embodiment is performed.

Figures 8A, 8B, 8C, 8D:
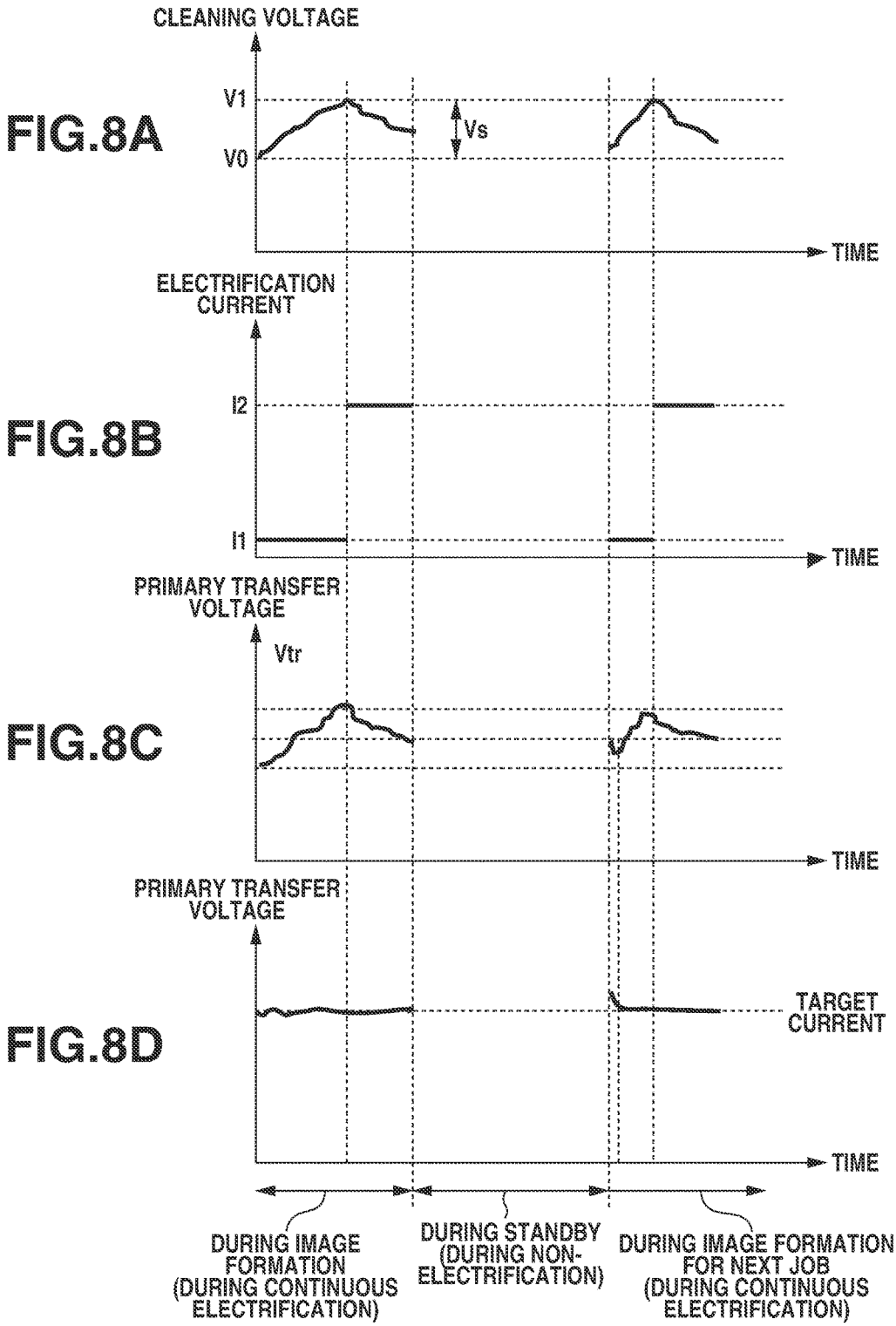
FIGS. 8A, 8B, 8C, and 8D are diagrams illustrating changes in a cleaning voltage, an opposing electrode current, a primary transfer voltage, and a primary transfer current, respectively, in a preceding image forming job and a subsequent image forming job according to the first exemplary embodiment.

As illustrated in FIGS. 8A and 8B, if V1−V0 is the threshold Vs or more, a current (an electrification current) to be applied from the opposing electrode 42 is switched from the first current value I1 to the second current value I2. Further, as illustrated in FIG. 8C, the primary transfer voltage Vtr fluctuates due to sheet-to-sheet interval voltage correction. As illustrated in FIG. 8D, if a next image forming job is performed using the primary transfer voltage Vtr set last in the previous image forming job, the current value of the primary transfer current is greater than the target current value by about 5 μA. However, a toner image is primarily transferred in an excellent manner such that the tint of the toner image subjected to image formation does not fluctuate.

If, on the other hand, a next image forming job is executed using a voltage set last in the previous image forming job without using the control according to the present exemplary embodiment, the current value of the primary transfer current is greater than the target current value by about 10 μA, and the tint of a toner image changes.

Based on the above, the control according to the present exemplary embodiment is performed, whereby it is possible to suppress an increase in the resistance of the intermediate transfer belt 6. As a result, it is possible to reduce the occurrence of a transfer failure while reducing the execution frequency of control of a transfer voltage setting, such as ATVC in a pre-process immediately before the start of image formation. Thus, it is possible to improve productivity.

In the above description, to perform electrification control, the voltage value of a voltage to be applied to the bristle brush 122*b* on the downstream side in the belt cleaning device 12 is used. Alternatively, the voltage value of a voltage to be applied to the bristle brush 122*a* on the upstream side in the belt cleaning device 12 may be used.

A second exemplary embodiment is described using FIGS. 9 and 10 with reference to FIGS. 1 to 4 and 6. Also in the case of the present exemplary embodiment, similarly to the first exemplary embodiment, according to the output of the cleaning high-voltage power supply 230, the current of the opposing electrode 42 is switched between the first current value I1 and the second current value I2. The present exemplary embodiment, however, is different from the first exemplary embodiment in the method for setting the second current value I2. That is, in the first exemplary embodiment, the second current value I2 is set according to the absolute amount of moisture outside the apparatus, whereas in the present exemplary embodiment, the second current value I2 is set according to the difference (V1−V0) between the first output V0 and the second output V1. Other configurations and operations are similar to those of the first exemplary embodiment, and therefore, the differences from the first exemplary embodiment are mainly described below.

In the present exemplary embodiment, as illustrated in FIG. 9, the threshold Vs for switching the current Ir of the opposing electrode 42 between the first current value I1 and the second current value I2 can be changed according to the absolute amount of moisture outside the apparatus. The present exemplary embodiment is similar to the first exemplary embodiment in this respect.

On the other hand, as illustrated in FIG. 10, the second current value I2 can be changed according to the difference V1−V0. That is, if the difference V1−V0 is a first difference, the second current value I2 is set to a first value. If the difference V1−V0 is a second difference greater than the first difference, the second current value I2 is set to a second value greater in absolute value than the first value.

The reason for thus setting the second current value I2 according to the difference V1−V0 is as follows. That is, after the current Ir of the opposing electrode 42 is switched to the second current value I2, and even if V1−V0 increases (even if the resistance of the intermediate transfer belt 6 increases), the amount of the second current value I2 is made great, whereby an increase in the resistance of the intermediate transfer belt 6 is appropriately suppressed.

Also in the case of the present exemplary embodiment as described above, it is possible to suppress an increase in the resistance of the intermediate transfer belt 6. As a result, it is possible to reduce the occurrence of a transfer failure while reducing the execution frequency of control of a transfer voltage setting, such as ATVC in a pre-process immediately before the start of image formation. Thus, it is possible to improve productivity.

A third exemplary embodiment is described using FIGS. 11A to 13 with reference to FIGS. 1 to 4. In the cases of the first and second exemplary embodiments, according to the output of the cleaning high-voltage power supply 230, the current of the opposing electrode 42 is switched between the first current value I1 and the second current value I2. In contrast, in the case of the present exemplary embodiment, according to the output of the transfer high-voltage power supply 220, the current of the opposing electrode 42 is switched between the first current value I1 and the second current value I2. Other configurations and operations are similar to those of the second exemplary embodiment, and therefore, the differences from the second exemplary embodiment are mainly described below.

In the present exemplary embodiment, according to the relationship between a voltage to be applied from the transfer high-voltage power supply 220 and a current to flow through the intermediate transfer belt 6 in a case where this voltage is applied, the CPU 200 controls the amount of current to be applied from the opposing electrode 42 to the intermediate transfer belt 6. In the case of the present exemplary embodiment, the transfer high-voltage power supply 220, which can apply a voltage to the primary transfer roller 5*k*, corresponds to a voltage application unit. That is, the transfer high-voltage power supply 220 can apply a voltage so that a predetermined current (e.g., a target current value of 40 μA) flows from the primary transfer roller 5*k* to the intermediate transfer belt 6. Then, according to the output (the voltage) of the transfer high-voltage power supply 220 to be applied so that the predetermined current flows, the CPU 200 controls the amount of current to be applied from the opposing electrode 42 to the intermediate transfer belt 6.

Specifically, the voltage (the primary transfer voltage) of the transfer high-voltage power supply 220 to be applied so that a predetermined current flows at a predetermined timing is a first output V0. The predetermined timing is any time before the start of image formation for the first image forming job input after the power supply of the apparatus is turned on after a predetermined time or more elapses since the power supply of the apparatus is turned off. In the present exemplary embodiment, at any timing before the first image forming job is input after the power supply of the apparatus is turned on after the predetermined time or more elapses since the power supply of the apparatus is turned off, ATVC is executed. Then, the primary transfer voltage set by the ATVC is the first output V0. That is, the primary transfer voltage set by the ATVC so that a target current value flows is the first output V0.

Further, the voltage (the primary transfer voltage) of the transfer high-voltage power supply 220 to be applied so that a predetermined current flows during the execution of an image forming job after the predetermined timing is a second output V1. In the present exemplary embodiment, the primary transfer voltage set by the control of sheet-to-sheet interval voltage correction performed during the execution of an image forming job is the second output V1. "The predetermined current" as used herein has some margin (e.g., ±2 μA) with respect to a target current value, but can be considered almost the same as the predetermined current in a case where the first output V0 is obtained. Then, according to the difference between the first output V0 and the second output V1, the CPU 200 controls the amount of current Ir to be applied from the opposing electrode 42 to the intermediate transfer belt 6.

That is, the first output V0 detected at a predetermined timing is set as a reference voltage, and based on the difference between the first output V0 and the second output V1, which is detected during the execution of an image forming job after the predetermined timing, a current to be applied from the opposing electrode 42 to the intermediate transfer belt 6 is determined. Specifically, if the difference between the first output V0 and the second output V1 is less than a threshold (V1−V0<Vs), the CPU 200 applies a current having a first current value I1 from the opposing electrode 42 to the intermediate transfer belt 6. If, on the other hand, the difference is the threshold or more (V1−V0≥Vs), the CPU 200 applies a current having a second current value I2, which is greater in absolute value than the first current value I1, from the opposing electrode 42 to the intermediate transfer belt 6. The first current value I1 may be 0 μA. That is, if the difference is less than the threshold, the CPU 200 may not apply a current from the opposing electrode 42 to the intermediate transfer belt 6. If the difference is the threshold or more, the CPU 200 may apply a current from the opposing electrode 42 to the intermediate transfer belt 6.

Figure 11:
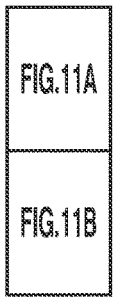
FIG. 11, including
Figure 11A:
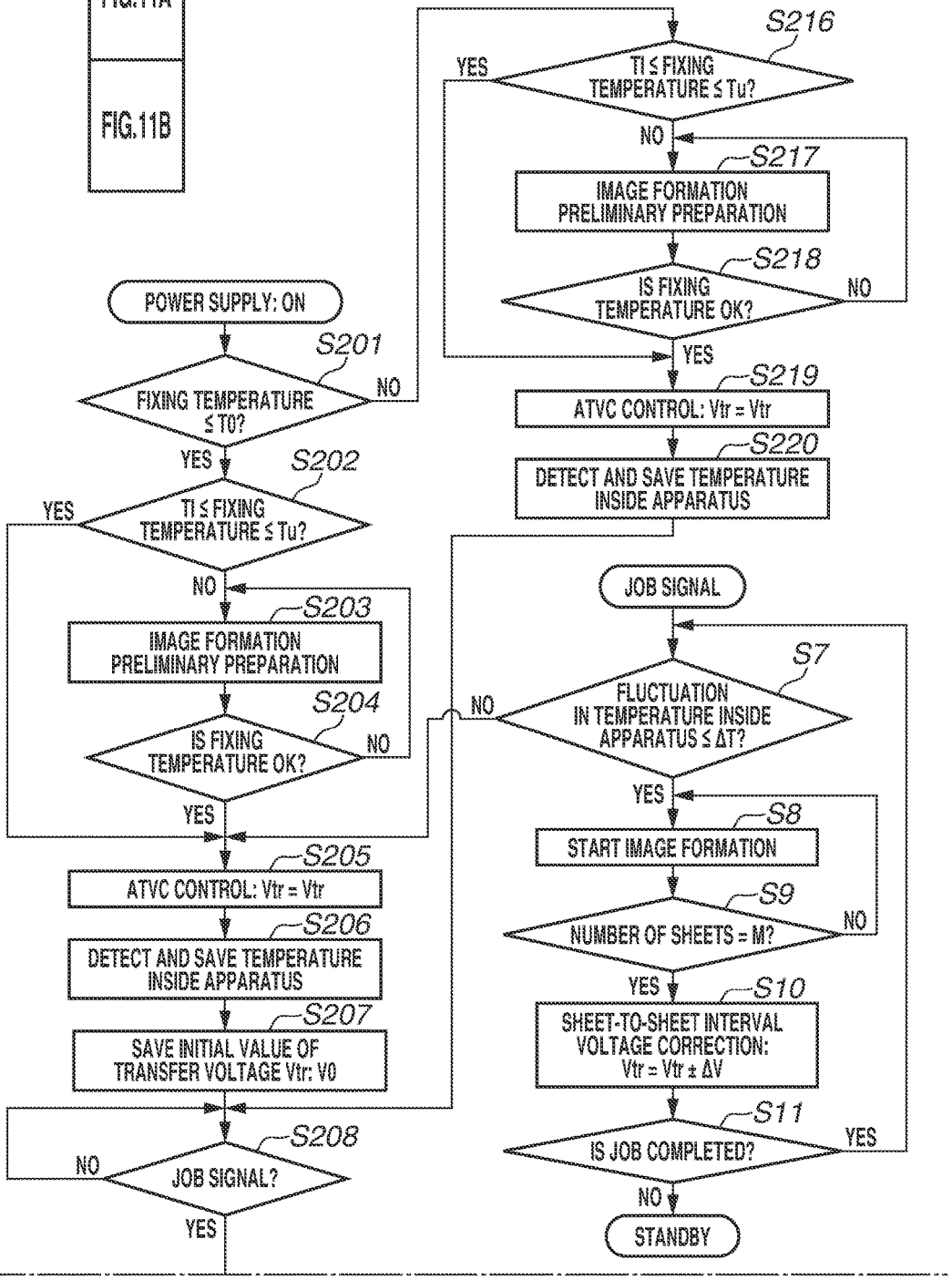
FIGS. 11A and 11B, is a flowchart illustrating voltage control according to a third exemplary embodiment.
Figure 11B:
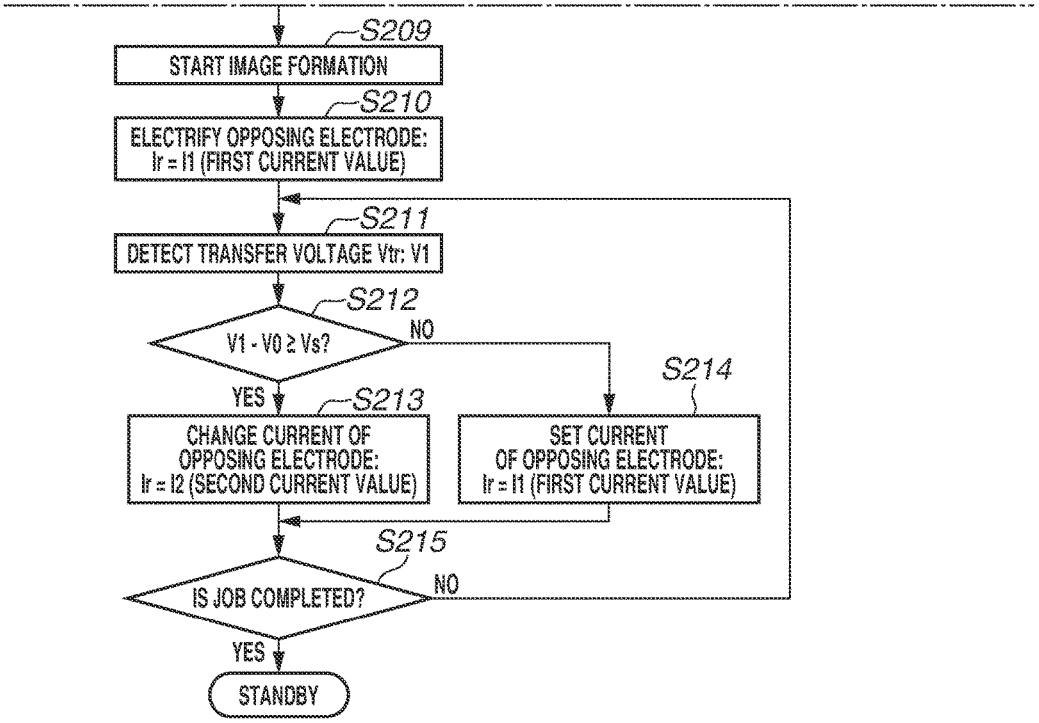

An example of the electrification control according to the present exemplary embodiment as described above is described using FIGS. 11A and 11B. The description of steps in a flowchart in FIGS. 11A and 11B that are similar to those in the flow in FIG. 5 is simplified. Further, the description of portions redundant with the description of the flowchart in FIGS. 6A and 6B in the first exemplary embodiment is omitted or simplified.

If the power switch 201 is turned on, then in step S201, the CPU 200 determines whether a fixing temperature is a predetermined temperature T0 or less. In a case where the fixing temperature is T0 or less in step S201 (YES in step S201), then in step S202, the CPU 200 determines whether the fixing temperature is within the range of Tl to Tu (Tl or more and Tu or less). In a case where the fixing temperature is outside this range (NO in step S202), the processing proceeds to step S203. In step S203, the CPU 200 starts image formation preliminary preparation. In step S204, in a case where the fixing temperature falls within the range of Tl to Tu during the image formation preliminary preparation, the CPU 200 determines that the fixing temperature is within an appropriate range (YES in step S204), and then the processing proceeds to step S205. In step S205, the CPU 200 performs ATVC to set a primary transfer voltage Vtr.

In a case where, on the other hand, the fixing temperature is within the range of Tl to Tu in step S202 (YES in step S202), the CPU 200 does not execute image formation preliminary preparation, and in step S205, the CPU 200 executes ATVC. At this time, in step S206, the CPU 200 detects the temperature inside the apparatus using the inside-apparatus temperature sensor 203 and stores the temperature inside the apparatus in the storage unit 204. Further, in step S207, the CPU 200 stores the primary transfer voltage Vtr set by the ATVC, as an initial value (first output) V0 of the transfer voltage Vtr in the storage unit 204. Then, in step S208, the CPU 200 enters a waiting state where the CPU 200 waits for the input of a job signal.

In a case where the fixing temperature is higher than T0 in step S201 (NO in step S201), the CPU 200 determines that the time in which the intermediate transfer belt 6 is left without being electrified is less than 30 minutes. Then, the CPU 200 does not update the initial value V0 of the transfer voltage Vtr. Then, steps S216 to S220 are executed. Steps S216 to S220 are similar to steps S202 to S206, and steps S202 to S206 are similar to steps S1 to S5 in FIG. 5. After step S220, the processing proceeds to step S208. In step S208, the CPU 200 enters a waiting state where the CPU 200 waits for the input of a job signal.

In a case where a job signal is input in step S208 (YES in step S208), the processing proceeds to step S209. In step S209, image formation is started. Then, in step S210, the CPU 200 applies a current having a first current value I1, as a current Ir with which to electrify the opposing electrode 42. Further, in a case where a job signal is input, then as illustrated on the right of the flowchart in FIG. 11A, the control of sheet-to-sheet interval voltage correction (steps S7 to S11) is executed in parallel with control in and after step S209.

After step S210, then in step S211, the CPU 200 detects, as a second output V1, the primary transfer voltage Vtr set by the control of sheet-to-sheet interval voltage correction. Next, in step S212, the CPU 200 determines whether the difference (V1−V0) between the first output V0 and the second output V1 is a threshold Vs or more. In a case where V1−V0 is Vs or more (YES in step S212), then in step S213, the CPU 200 changes the current Ir with which to electrify the opposing electrode 42 to a second current value I2. In a case where, on the other hand, V1−V0 is less than Vs (NO in step S212), then in step S214, the CPU 200 sets the current Ir with which to electrify the opposing electrode 42 to the first current value I1. The control in steps S211 to S214 is performed during the execution of an image forming job, i.e., until the job is completed. In a case where the job is completed (YES in step S215), the CPU 200 enters a standby state.

The reason why the primary transfer voltage Vtr to be applied to the primary transfer roller 5*k* is used to calculate V1−V0 in the present exemplary embodiment is as follows. That is, the intermediate transfer belt 6 is continuously electrified by the primary transfer rollers 5Y, 5M, 5C, and 5*k*, and currents flow in the same direction. Thus, the primary transfer voltage to be applied to the primary transfer roller 5*k*, which is the furthest downstream, is the most sensitive to a fluctuation in the resistance of the intermediate transfer belt 6. That is, the primary transfer voltage of the primary transfer roller 5*k* is set taking into account the influence of a current from a primary transfer roller on the upstream side to the intermediate transfer belt 6 on a fluctuation in the resistance of the intermediate transfer belt 6. Thus, among the four primary transfer rollers 5Y, 5M, 5C, and 5*k*, the primary transfer voltage of the primary transfer roller 5*k* is most influenced by a fluctuation in the resistance of the intermediate transfer belt 6. Thus, the primary transfer voltage of the primary transfer roller 5*k* is used to calculate V1−V0, whereby it is possible to detect a fluctuation in the resistance of the intermediate transfer belt 6 with excellent sensitivity.

In the case of the present exemplary embodiment, similarly to the second exemplary embodiment, as illustrated in FIG. 12, the threshold Vs can be changed according to the absolute amount of moisture outside the apparatus. Further, as illustrated in FIG. 13, the second current value I2 can be changed according to the difference V1−V0. Alternatively, similarly to the first exemplary embodiment, the second current value I2 may be able to be changed according to the absolute amount of moisture outside the apparatus.

Also in the case of the present exemplary embodiment as described above, it is possible to suppress an increase in the resistance of the intermediate transfer belt 6. As a result, it is possible to reduce the occurrence of a transfer failure while reducing the execution frequency of control of a transfer voltage setting, such as ATVC in a pre-process immediately before the start of image formation. Thus, it is possible to improve productivity.

A fourth exemplary embodiment is described using FIGS. 14 to 17 with reference to FIGS. 2 to 4. In the cases of the first and second exemplary embodiments, according to the output of the cleaning high-voltage power supply 230, the current of the opposing electrode 42 is switched between the first current value I1 and the second current value I2. In the third exemplary embodiment, according to the output of the transfer high-voltage power supply 220, the current of the opposing electrode 42 is switched between the first current value I1 and the second current value I2. In contrast, in the case of the present exemplary embodiment, according to the output of the cleaning high-voltage power supply 230 and the output of an electrification high-voltage power supply 240A, the current of the stretching roller 23 is switched between the first current value I1 and the second current value I2. Other configurations and operations are similar to those of the first exemplary embodiment, and therefore, the differences from the first exemplary embodiment are mainly described below.

Figure 14:
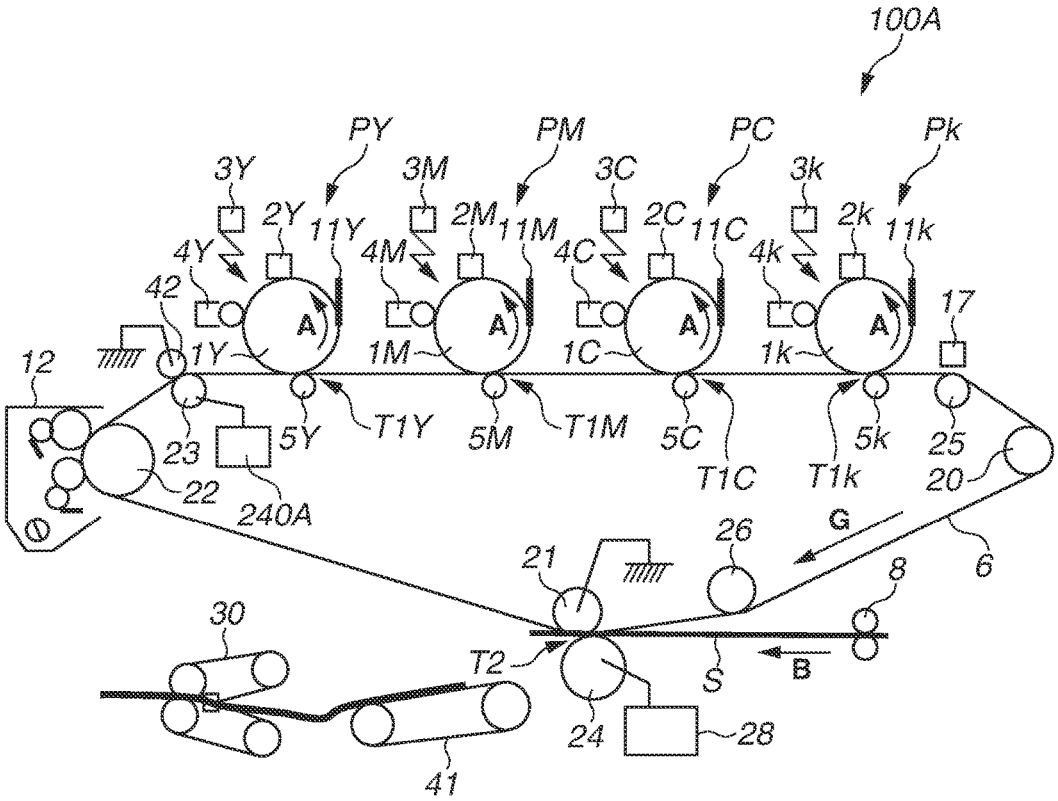
FIG. 14 is a diagram illustrating a general configuration of an image forming apparatus according to a fourth exemplary embodiment.

As illustrated in FIG. 14, an image forming apparatus 100A according to the present exemplary embodiment applies a voltage having a negative polarity to the stretching roller 23, which is placed facing the opposing electrode 42 through the intermediate transfer belt 6, whereby the intermediate transfer belt 6 is electrified. That is, in the present exemplary embodiment, the stretching roller 23 corresponds to an electrification unit for applying a current in the opposite direction to that of the primary transfer current to the intermediate transfer belt 6. The stretching roller 23 is connected to an electrification high-voltage power supply 240A, and the opposing electrode 42 is grounded. Then, the electrification high-voltage power supply 240A applies a voltage having a negative polarity to the stretching roller 23, whereby a current in the opposite direction to that of the primary transfer current flows from the stretching roller 23 to the intermediate transfer belt 6.

Further, in the rotational direction of the intermediate transfer belt 6, the stretching roller 23 is placed upstream of the primary transfer portion T1Y and at the position where another member for applying a voltage to the intermediate transfer belt 6 is not provided between the stretching roller 23 and the belt cleaning device 12. That is, the stretching roller 23 is placed at a position adjacent to the belt cleaning device 12 in the rotational direction of the intermediate transfer belt 6. The difference between the voltage values of members adjacent to each other as described above is detected, whereby it is possible to estimate an increase in the resistance of the intermediate transfer belt 6 more accurately.

Further, in the present exemplary embodiment, the cleaning high-voltage power supply 230 corresponds to a first power supply, and the electrification high-voltage power supply 240A corresponds to a second power supply. According to the relationships between voltages to be applied from the cleaning high-voltage power supply 230 and the electrification high-voltage power supply 240A and currents to flow through the intermediate transfer belt 6 in a case where these voltages are applied, the CPU 200 controls the amount of current to be applied from the stretching roller 23 to the intermediate transfer belt 6.

Specifically, the voltage of the cleaning high-voltage power supply 230 to be applied so that a first current (e.g., +35 μA) flows at a predetermined timing is a first pre-output (cleaning initial voltage) Vc0. Further, the voltage of the electrification high-voltage power supply 240A to be applied so that a second current (e.g., −35 μA) flows at the predetermined timing is a second pre-output Vr0. Then, the output difference (Vc0−Vr0) between the first pre-output Vc0 and the second pre-output Vr0 is a first output difference ΔV0.

Further, the voltage of the cleaning high-voltage power supply 230 to be applied so that the first current flows when image formation is started after the predetermined timing is a first post-output Vc. Further, the voltage of the electrification high-voltage power supply 240A to be applied so that the second current flows during the execution of an image forming job after the predetermined timing is a second post-output Vr. Then, the output difference (Vc−Vr) between the first post-output Vc and the second post-output Vr is a second output difference ΔV.

In this case, according to a difference D between the first output difference ΔV0 and the second output difference ΔV (=ΔV−ΔV0), the CPU 200 controls the amount of current Ir to be applied from the stretching roller 23 to the intermediate transfer belt 6. The predetermined timing is similar to that in the first exemplary embodiment.

In the present exemplary embodiment, constant current control is performed so that a first current flows from the bristle brush 122*b*, which is on the downstream side in the belt cleaning device 12, to the intermediate transfer belt 6. The cleaning voltage detection sensor 231 detects the voltage of the cleaning high-voltage power supply 230 at this time, whereby the first pre-output Vc0 and the first post-output Vc are obtained. Further, a voltage is applied from the electrification high-voltage power supply 240A so that a second current flows from the stretching roller 23 to the intermediate transfer belt 6. The electrification voltage detection sensor 241 detects the voltage of the electrification high-voltage power supply 240A at this time, whereby the second pre-output Vr0 and the second post-output Vr are obtained.

Further, the first output difference ΔV0 between the first pre-output Vc0 and the second pre-output Vr0 detected at a predetermined timing is set as a reference voltage difference, and based on the difference D between the first output difference ΔV0 and the second output difference ΔV between the first post-output Vc and the second post-output Vr, which are detected during the execution of an image forming job after the predetermined timing, the amount of current Ir to be applied from the stretching roller 23 is determined. Specifically, if the difference D between the first output difference ΔV0 and the second output difference ΔV is less than a threshold (D<Vs), the CPU 200 applies a current having a first current value I1 from the stretching roller 23 to the intermediate transfer belt 6. If, on the other hand, the difference D is the threshold or more (D≥Vs), the CPU 200 applies a current having a second current value I2, which is greater in absolute value than the first current value I1, from the stretching roller 23 to the intermediate transfer belt 6. The first current value I1 may be 0 μA. That is, if the difference D is less than the threshold, the CPU 200 may not apply a current from the stretching roller 23 to the intermediate transfer belt 6. If the difference D is the threshold or more, the CPU 200 may apply a current from the stretching roller 23 to the intermediate transfer belt 6.

Figure 15:
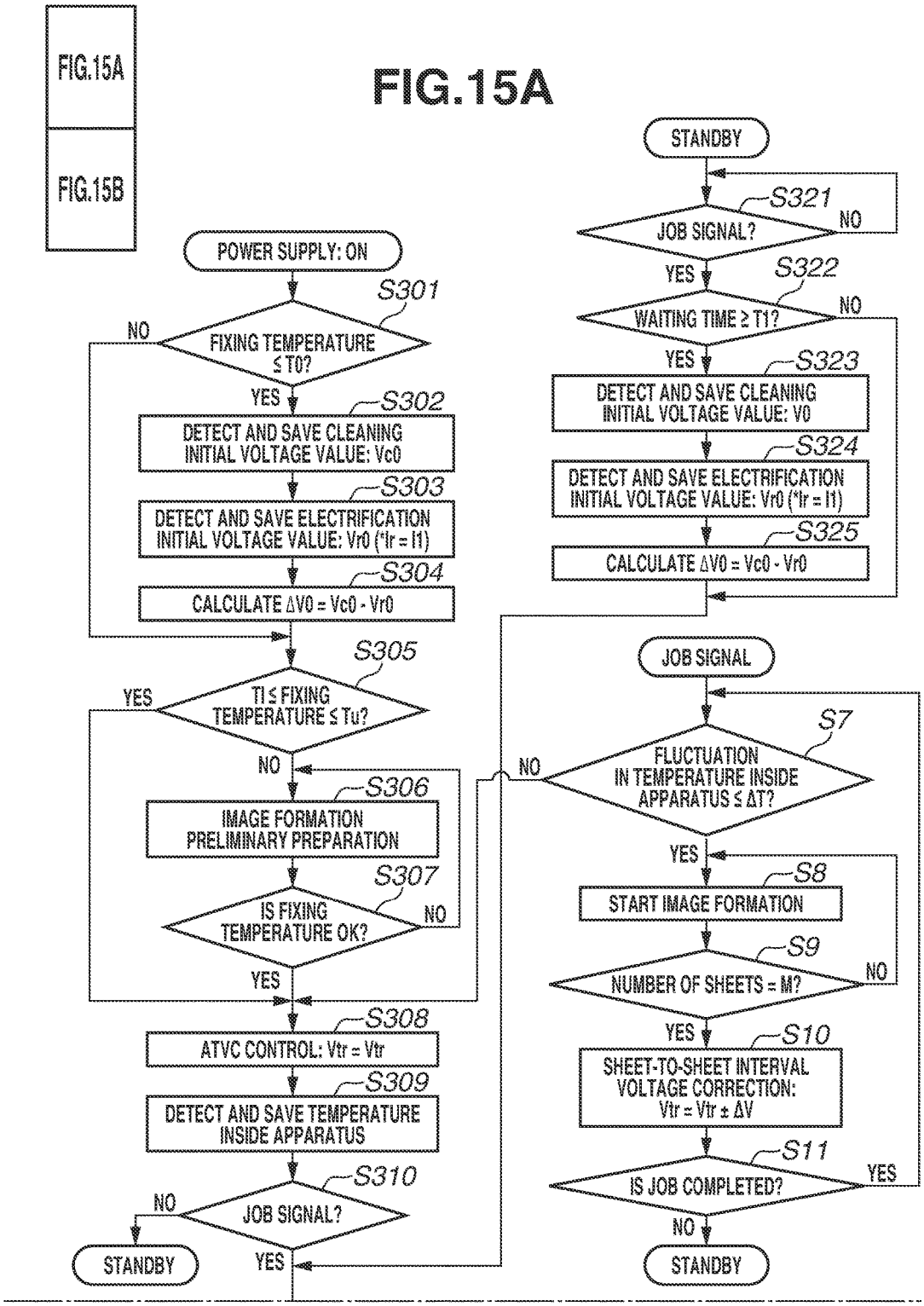
FIG. 15, including
Figure 15B:
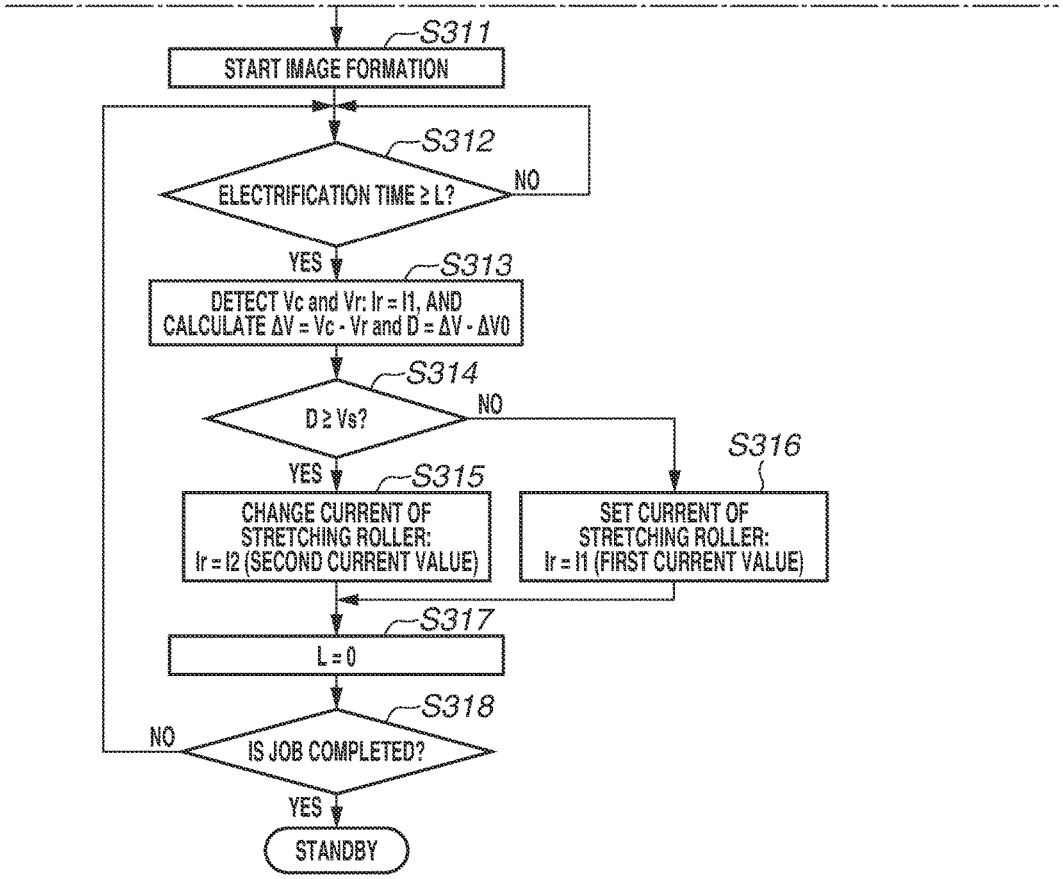

An example of the electrification control according to the present exemplary embodiment as described above is described using FIGS. 15A and 15B. The description of steps in a flowchart in FIGS. 15A and 15B that are similar to those in the flowchart in FIG. 5 is simplified. Further, the description of portions redundant with the description of the flowchart in FIGS. 6A and 6B in the first exemplary embodiment is omitted or simplified.

If the power switch 201 is turned on, then in step S301, the CPU 200 determines whether a fixing temperature is a predetermined temperature T0 or less. In a case where the fixing temperature is T0 or less in step S301 (YES in step S301), the CPU 200 drives the intermediate transfer belt 6 to rotate. Then, in step S302, the CPU 200 detects a cleaning initial voltage value (first pre-output) Vc0 of a voltage to be applied to apply a first current (+35 μA) controlled at a constant current to the metal roller 123*b* of the bristle brush 122*b*, and saves the cleaning initial voltage value Vc0 in the storage unit 204.

Further, in step S303, the CPU 200 applies a current having a first current value I1 (a second current), as a current Ir with which to electrify the stretching roller 23. In the present exemplary embodiment, I1 is set to −35 μA. The present exemplary embodiment, however, is not limited to this. At this time, the CPU 200 detects an electrification initial voltage value (second pre-output) Vr0 and saves the electrification initial voltage value Vr0 in the storage unit 204. Then, in step S304, the CPU 200 calculates an initial difference voltage (first output difference) ΔV0=Vc0−Vr0.

Next, in step S305, the CPU 200 determines whether the fixing temperature is within the range of Tl to Tu (Tl or more and Tu or less). In a case where the fixing temperature is outside this range (NO in step S305), the processing proceeds to step S306. In step S306, the CPU 200 starts image formation preliminary preparation. In step S307, in a case where the fixing temperature falls within the range of Tl to Tu during the image formation preliminary preparation, the CPU 200 determines that the fixing temperature is within an appropriate range (YES in step S307). In step S308, the CPU 200 performs ATVC to set a primary transfer voltage Vtr.

In a case where, on the other hand, the fixing temperature is within the range of Tl to Tu in step S305 (YES in step S305), the CPU 200 does not execute image formation preliminary preparation, and in step S308, the CPU 200 executes ATVC. At this time, in step S309, the CPU 200 detects the temperature inside the apparatus using the inside-apparatus temperature sensor 203 and stores the temperature inside the apparatus in the storage unit 204. Then, in step S310, the CPU 200 enters a waiting state where the CPU 200 waits for the input of a job signal.

In a case where the fixing temperature is higher than T0 in step S301 (NO in step S301), the CPU 200 does not update the initial difference voltage ΔV0, and the processing proceeds to step S305. In steps S305 to S309, similarly, the CPU 200 performs ATVC, and the CPU 200 detects, stores, and saves the temperature inside the apparatus. After step S309, then in step S310, the CPU 200 enters a waiting state (a standby state) where the CPU 200 waits for the input of a job signal. Steps S305 to S309 are similar to steps S1 to S5 in FIG. 5.

In a case where the CPU 200 does not enter a standby state, and a job signal is input in step S310 (YES in step S310), the processing proceeds to step S311. In step S311, image formation is immediately started. In a case where, on the other hand, a job signal is not input in step S310 (NO in step S310), and the CPU 200 enters a standby state, the processing proceeds to the upper right of the flow in FIG. 15A. In step S321, in a case where a job signal is input in the standby state where the CPU 200 waits for a job signal (YES in step S321), the processing proceeds to step S322. In step S322, the CPU 200 determines whether a waiting time in which the CPU 200 waits for a job signal is T1 or more. In a case where a job signal is input in the standby state (YES in step S321), and the waiting time is T1 or more (YES in step S322) before image formation is started in step S311, the CPU 200 drives the intermediate transfer belt 6 to rotate.

Then, in step S323, the CPU 200 detects the cleaning initial voltage value (first pre-output) Vc0 of a voltage to be applied to apply the first current (+35 μA) controlled at a constant current to the metal roller 123*b* of the bristle brush 122*b*, and saves the cleaning initial voltage value Vc0 in the storage unit 204. Further, in step S324, the CPU 200 applies the second current (the first current value I1) as the current Ir with which to electrify the stretching roller 23. At this time, the CPU 200 detects the electrification initial voltage value (second pre-output) Vr0 and saves the electrification initial voltage value Vr0 in the storage unit 204. Then, in step S325, the CPU 200 calculates the initial difference voltage (first output difference) ΔV0=Vc0−Vr0. That is, the CPU 200 updates ΔV0.

If image formation is started in step S311, then in step S312, the CPU 200 determines whether an electrification time in which the stretching roller 23 electrifies the intermediate transfer belt 6 is L or more. In the present exemplary embodiment, L=one minute. The present exemplary embodiment, however, is not limited to this. In a case where the electrification time is L or more in step S312 (YES in step S312), the CPU 200 detects a cleaning voltage (first post-output) Vc controlled at a constant current to achieve the first current. In the present exemplary embodiment, Vc is a voltage to be applied to apply a current of +35 μA (the first current) controlled at a constant current and is +0.05 to +5 kV. Further, the CPU 200 detects a voltage Vr required to apply the second current (the first current value I1) as the current Ir with which to electrify the stretching roller 23. Then, in step S313, the CPU 200 calculates a second output difference ΔV=Vc−Vr and further calculates a difference voltage fluctuation D=ΔV−ΔV0.

Further, if a job signal is input, then as illustrated on the right of the flowchart in FIG. 15A, the control of sheet-to-sheet interval voltage correction (steps S7 to S11) is executed in parallel with control in and after step S311. This control of sheet-to-sheet interval voltage correction is as described in FIG. 5.

After step S313, then in step S314, the CPU 200 determines whether the difference voltage fluctuation D is a threshold Vs or more. In a case where D is Vs or more (YES in step S314), the processing proceeds to step S315. In step S315, the CPU 200 changes the current Ir with which to electrify the stretching roller 23 to a second current value I2. In a case where, on the other hand, D is less than Vs (NO in step S314), then in step S316, the CPU 200 sets the current Ir with which to electrify the stretching roller 23 to the first current value I1. Then, in step S317, the CPU 200 resets the electrification time L (L=0). The control in steps S312 to S317 is performed during the execution of an image forming job, i.e., until the job is completed. In a case where the job is completed (YES in step S318), the CPU 200 enters a standby state.

In the case of the present exemplary embodiment, the threshold Vs can be changed according to the absolute amount of moisture around the apparatus (outside the apparatus). That is, as described above, the CPU 200 can detect the absolute amount of moisture outside the apparatus using the outside-apparatus environment sensor 206 as the moisture amount detection unit, and according to the detected absolute amount of moisture, can change the threshold Vs as illustrated in FIG. 16. Further, in the case of the present exemplary embodiment, as illustrated in FIG. 16, the CPU 200 can also change the second current value I2 according to the detected absolute amount of moisture.

That is, if the absolute amount of moisture is a first amount of moisture, the threshold Vs is set to a first threshold. If the absolute amount of moisture is a second amount of moisture greater than the first amount of moisture, the threshold Vs is set to a second threshold greater than the first threshold. Similarly, if the absolute amount of moisture is a third amount of moisture, the second current value I2 is set to a first value. If the absolute amount of moisture is a fourth amount of moisture greater than the third amount of moisture, the second current value I2 is set to a second value greater in absolute value than the first value.

As described above, in the present exemplary embodiment, according to the output of the cleaning high-voltage power supply 230 and the output of the electrification high-voltage power supply 240A, a current to be applied from the stretching roller 23 to the intermediate transfer belt 6 is switched between the first current value I1 and the second current value I2. Consequently, even if, as the primary transfer voltage Vtr during image formation for a next job (during the execution of a next image forming job), the last voltage setting in the previous job is used without executing ATVC, it is possible to reduce a fluctuation in the primary transfer current.

A description is given of the result of examining the primary transfer current when image formation for a next job is performed using the setting value of the last primary transfer voltage in the previous image forming job, in each of a case where the control according to the present exemplary embodiment as described above is performed, and a case where the control is not performed. FIGS. 17A to 17D illustrate the case where the control according to the present exemplary embodiment is performed.

Figures 17A, 17B, 17C, 17D:
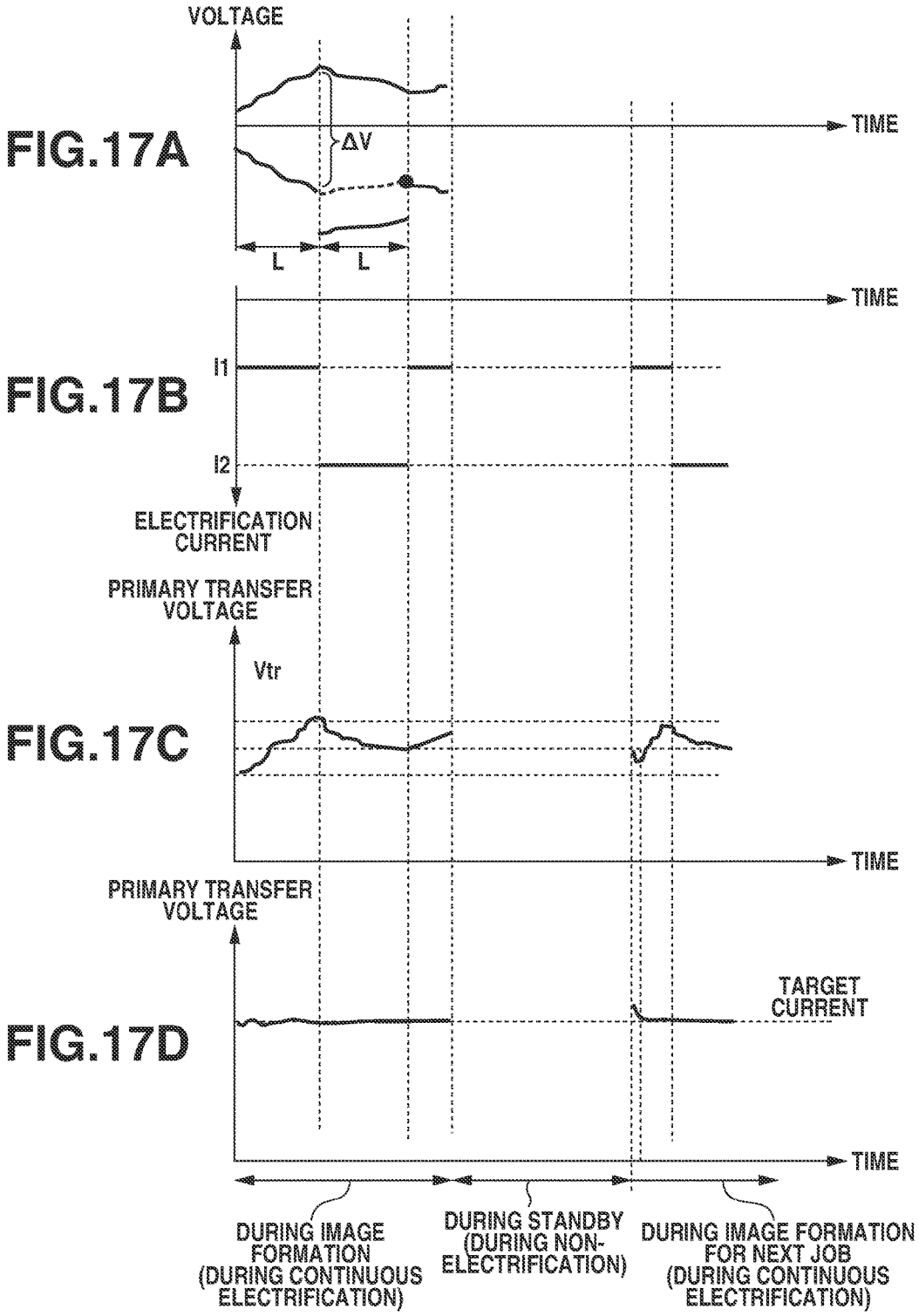
FIGS. 17A, 17B, 17C, and 17D are diagrams illustrating changes in a difference voltage between a cleaning voltage and an opposing electrode voltage, an opposing electrode current, a primary transfer voltage, and a primary transfer current, respectively, in a preceding image forming job and a subsequent image forming job according to the fourth exemplary embodiment.

As illustrated in FIGS. 17A and 17B, if ΔV is the threshold Vs or more, a current (an electrification current) to be applied from the stretching roller 23 is switched from the first current value I1 to the second current value I2. Further, as illustrated in FIG. 17C, the primary transfer voltage Vtr fluctuates due to sheet-to-sheet interval voltage correction. As illustrated in FIG. 17D, if a next image forming job is performed using the primary transfer voltage Vtr set last in the previous image forming job, the current value of the primary transfer current is greater than the target current value by about 5 μA. However, a toner image is primarily transferred in an excellent manner such that the tint of the toner image subjected to image formation does not fluctuate.

If, on the other hand, a next image forming job is executed using a voltage set last in the previous image forming job without using the control according to the present exemplary embodiment, the current value of the primary transfer current is greater than the target current value by about 10 μA, and the tint of a toner image changes.

Based on the above, the control according to the present exemplary embodiment is performed, whereby it is possible to suppress an increase in the resistance of the intermediate transfer belt 6. As a result, it is possible to reduce the occurrence of a transfer failure while reducing the execution frequency of control of a transfer voltage setting, such as ATVC in a pre-process immediately before the start of image formation. Thus, it is possible to improve productivity.

A fifth exemplary embodiment is described using FIGS. 18 and 19 with reference to FIGS. 2 to 4, 14, 15A and 15B. Also in the case of the present exemplary embodiment, similarly to the fourth exemplary embodiment, according to the output of the cleaning high-voltage power supply 230 and the output of the electrification high-voltage power supply 240A, the current of the stretching roller 23 is switched between the first current value I1 and the second current value I2. The present exemplary embodiment, however, is different from the fourth exemplary embodiment in the method for setting the second current value I2. That is, in the fourth exemplary embodiment, the second current value I2 is set according to the absolute amount of moisture outside the apparatus, whereas in the present exemplary embodiment, the second current value I2 is set according to the difference D between the first output difference ΔV0 and the second output difference ΔV (ΔV−ΔV0). Other configurations and operations are similar to those of the fourth exemplary embodiment, and therefore, the differences from the fourth exemplary embodiment are mainly described below.

In the present exemplary embodiment, as illustrated in FIG. 18, the threshold Vs for switching the current Ir of the stretching roller 23 between the first current value I1 and the second current value I2 can be changed according to the absolute amount of moisture outside the apparatus. The present exemplary embodiment is similar to the fourth exemplary embodiment in this respect.

On the other hand, as illustrated in FIG. 19, the second current value I2 can be changed according to the difference D. That is, if the difference D is a first difference, the second current value I2 is set to a first value. If the difference D is a second difference greater than the first difference, the second current value I2 is set to a second value greater in absolute value than the first value.

The reason for thus setting the second current value I2 according to the difference D is as follows. That is, after the current Ir of the stretching roller 23 is switched to the second current value I2, and even if the difference D increases (even if the resistance of the intermediate transfer belt 6 increases), the amount of the second current value I2 is made great, whereby an increase in the resistance of the intermediate transfer belt 6 is appropriately suppressed.

Also in the case of the present exemplary embodiment as described above, it is possible to suppress an increase in the resistance of the intermediate transfer belt 6. As a result, it is possible to reduce the occurrence of a transfer failure while reducing the execution frequency of control of a transfer voltage setting, such as ATVC in a pre-process immediately before the start of image formation. Thus, it is possible to improve productivity.

In the above exemplary embodiments, an electrification unit for applying a current in the opposite direction to that of the primary transfer current to the intermediate transfer belt 6 may be the opposing electrode or the stretching roller 23. The point is that the polarity of a voltage to be applied may be appropriately set so that a current in the opposite direction to that of the primary transfer current flows through the intermediate transfer belt 6.

In the above exemplary embodiment, electrification control is performed to control the amount of current to be applied from the opposing electrode 42 or the stretching roller 23 to the intermediate transfer belt 6, using the voltage value of any of the cleaning high-voltage power supply 230, the transfer high-voltage power supply 220, and the electrification high-voltage power supply 240A. Alternatively, such electrification control may be performed using another voltage value so long as an increase in the resistance of the intermediate transfer belt 6 can be estimated. For example, electrification control may be performed by detecting the voltage value of a voltage to be applied to the secondary transfer device. Yet alternatively, a unit for applying a current to the intermediate transfer belt 6 may be separately provided, and the voltage value of this unit may be used.

In the fourth and fifth exemplary embodiments, electrification control is performed using the voltage values of the cleaning high-voltage power supply 230 and the electrification high-voltage power supply 240A. In the fourth and fifth exemplary embodiments, however, the voltage value of another portion may be used so long as the voltage values of members adjacent to each other can be detected. For example, the voltage values of the opposing electrode 42 or the stretching roller 23 as an electrification unit, and the primary transfer roller 5Y adjacent to the electrification unit may be used. That is, electrification control may be performed using the voltage values of the electrification high-voltage power supply 240 or 240A and the transfer high-voltage power supply 220.

The above electrification control is performed using the voltage value of the belt cleaning device 12. Alternatively, a predetermined voltage may be applied to the belt cleaning device 12, and the electrification control may be performed using the current value of a current flowing at this time. The point is that an increase in the resistance of the intermediate transfer belt 6 can be estimated.

Further, in the present exemplary embodiments, a description has been given of a feedback method for, based on a voltage value or a current value detected during image formation, estimating an increase in the resistance of an intermediate transfer belt. The present exemplary embodiments, however, are not limited to this. For example, a feedforward method can also be employed as follows. That is, the sum of currents to flow in the thickness direction of the intermediate transfer belt during image formation (on the assumption that the direction in which a current flows from the inner surface to the outer surface of the intermediate transfer belt is positive) is known in advance. Thus, a current to be applied from an electrification unit to the intermediate transfer belt may be adjusted so that the balance of currents to flow in the thickness direction of the intermediate transfer belt is substantially zero. That is, when the current value of a current with which to electrify the intermediate transfer belt in the direction from the inner peripheral surface to the outer peripheral surface of the intermediate transfer belt is positive, a primary transfer current is positive, and a secondary transfer current is negative. Further, the configuration may be such that if any members in addition to a primary transfer roller and a secondary transfer roller apply currents to the intermediate transfer belt, the balance of currents of these members is obtained in advance. Then, a current is applied to the electrification unit so that the balance of currents is substantially zero. In this case, the balance of currents may not necessarily be zero. For example, suppose that the absolute value of the combined balance of currents of the primary transfer current and the secondary transfer current is It. Then, the amount of electrification of the electrification unit is controlled so that an absolute value Iall of the balance of all currents flowing through the intermediate transfer belt in the thickness direction of the intermediate transfer belt during image formation is half or less of It, whereby it is possible to obtain the effects of the present embodiment. That is, the electrification unit may be controlled so that $|Iall|<\frac{1}{2}|It|$ is satisfied. This control is described using a specific example. In the present exemplary embodiments, if the primary transfer current is 40 μA, and the secondary transfer current is 120 μA, It=40×4-120=40. Further, currents to be applied to upstream and downstream bristle brushes are 55 and −35 μA, respectively. Thus, if a current to be applied to the electrification unit is Ix, it is desirable that $|Iall=55-35+It+Ix|<|\frac{1}{2}\times It|$. That is, if It=40 is substituted into this formula, 80>Ix>40. Further, it is more desirable that $|Iall|<\frac{1}{4}|It|$.

In the present exemplary embodiments, when the balance of currents flowing in the thickness direction of the intermediate transfer member is substantially zero, the balance of currents is $\frac{1}{10}$ or less of It. With regard to the above-described relationship of the balance between the currents, e.g., $|Iall|<\frac{1}{2}|It|$, it is desirable that the balance of currents is satisfied at least during a predetermined time period described as follows. The predetermined time period is a time period from when a leading end portion of an image on a first sheet passes the secondary transfer portion until when a trailing end of an image on a hundredth sheet enters the second transfer portion, while images are successively formed.

The image forming apparatus according to the present invention is applicable to a copying machine, a facsimile, and a multifunction peripheral having a plurality of functions of these apparatuses, in addition to a printer.

According to the present disclosure, it is possible to suppress an increase in the resistance of an intermediate transfer member.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2017-022567, filed Feb. 9, 2017, which is hereby incorporated by reference herein in its entirety.

What is claimed is:

1. An image forming apparatus comprising:

a plurality of image bearing members configured to bear toner images;

an intermediate transfer belt onto which the toner images are transferred from the plurality of image bearing members;

a plurality of primary transfer devices configured to, at primary transfer portions, transfer the toner images from the plurality of image bearing members onto the intermediate transfer belt;

a secondary transfer device configured to, at a secondary transfer portion, transfer the toner images transferred onto the intermediate transfer belt onto a sheet;

a first cleaning member provided in contact with said intermediate transfer belt at a portion downstream of said secondary transfer portion and upstream of said primary transfer portions in a rotational moving direction of said intermediate transfer belt, said first cleaning member being configured to collect the toner from said intermediate transfer belt by a current flowing to the first cleaning member;

a second cleaning member provided in contact with said intermediate transfer belt and at a portion downstream of said secondary transfer portion and the upstream of said primary transfer portions in the rotational moving direction of said intermediate transfer belt, said second cleaning member being configured to collect the toner from said intermediate transfer belt by a current flowing to the second cleaning member;

a discharge member provided in contact with said intermediate transfer belt at a discharging portion downstream of said secondary transfer portion and upstream of said primary transfer portions in the rotational moving direction of said intermediate transfer belt, said discharge member being configured to discharge said intermediate transfer belt by a discharge current flowing to the discharge member;

a first cleaning voltage source configured to flow the current to said first cleaning member;

a second cleaning voltage source configured to flow a current to said second cleaning member;

a discharge voltage source for applying a voltage to flow the discharge current to said discharge member; and a controller configured to control the discharge voltage source, wherein $|It1+It2+Ic11+Ic12+Id|<1/4\times|It1+It2|$ is satisfied, where It1 denotes a total current flowing to said primary transfer devices, It2 denotes a total current flowing to said secondary transfer device, It2 denotes a total current flowing to said first cleaning member, Ic12 denotes a total current flowing to said second cleaning member, and Id denotes a total current flowing to said discharge member during a period from passing of a leading edge of a first sheet through said secondary transfer device to passing of a trailing edge of a one hundredth sheet through said secondary transfer device in a successive image forming job of forming an image on a plurality of sheets successively, and each of the total currents is taken as positive in case that each of the total currents flows from an inner surface of said intermediate transfer belt toward an outer surface of said intermediate transfer belt.

2. The image forming apparatus according to claim 1, wherein $|It1+It2+Ic11+Ic12+Id|<1/10\times|It1+It2|$ is satisfied.

3. The image forming apparatus according to claim 1, wherein said intermediate transfer belt including an elastic layer containing an ion conductive agent.

4. The image forming apparatus according to claim 1, wherein said first cleaning member and said second cleaning member and the discharge member are bristle brushes.

5. The image forming apparatus according to claim 1, wherein the discharge member is provided at downstream of said first and second cleaning members and at upstream of said primary transfer portions in the rotational moving direction of said intermediate transfer belt.

6. The image forming apparatus according to claim 5, wherein the current flowing to the first cleaning member and the discharge current are negative current and the cleaning current flowing to the second cleaning member is positive current and an absolute value of the discharge current is larger than an absolute value of the current flowing to the first cleaning member.

7. The image forming apparatus according to claim 5, wherein the first cleaning member is provided at a portion downstream of the second cleaning member and upstream of said discharge member in the rotational moving direction of said intermediate transfer belt, and wherein said controller controls the first cleaning voltage source so that the current flowing to the first cleaning member is first predetermined current and controls the second cleaning voltage source so that the current flowing to the second cleaning member is second predetermined current and controls said discharge voltage source based on the voltage applied to the first cleaning member.

8. The image forming apparatus according to claim 7, wherein said controller controls said discharge voltage source based on the voltages applied to the first cleaning voltage source and the second cleaning voltage source.

9. The image forming apparatus according to claim 1, wherein said controller controls said discharge voltage source based on the voltage applied to the primary transfer device.

* * * * *